US005611223A

United States Patent [19]

Spitzer

[11] Patent Number: 5,611,223

[45] **Date of Patent: *Mar. 18, 1997**

[54] FAST ACCESS ELECTRONIC LOCKING SYSTEM AND METHOD OF USING SAME

[75] Inventor: Joseph C. Spitzer, San Diego, Calif.

[73] Assignee: Mardesich Enterprises, Inc., San Diego, Calif.

[ * ] Notice: The term of this patent shall not extend beyond the expiration date of Pat. No. 5,299,436.

[21] Appl. No.: 444,712

[22] Filed: May 19, 1995

Related U.S. Application Data

[63] Continuation of Ser. No. 206,974, Mar. 7, 1994, abandoned, which is a continuation of Ser. No. 781,011, Oct. 18, 1991, Pat. No. 5,299,436, which is a continuation-in-part of Ser. No. 492,737, Mar. 13, 1990, Pat. No. 5,085,395.

[51] Int. Cl.[6] ..... E05B 73/00

[52] U.S. Cl. ..... 70/58; 70/276; 70/413; 248/552

[58] Field of Search ..... 70/1.5, 57, 58, 70/62, 276–278, 413, 232; 248/499, 500, 503, 505, 551–553

[56] References Cited

U.S. PATENT DOCUMENTS

| | | | |
|---|---|---|---|
| 3,782,147 | 1/1974 | Hallmann | 70/276 |
| 3,837,195 | 9/1974 | Pelto | 70/276 |
| 3,967,479 | 7/1976 | Vick | 70/276 |
| 3,974,669 | 8/1976 | Stackhouse | 70/276 |
| 4,040,279 | 8/1977 | Signorelli et al. | 70/34 |
| 4,289,000 | 9/1981 | Nielsen, Jr. | 70/34 |
| 4,307,589 | 12/1981 | Kajita | 70/276 |
| 4,492,100 | 1/1985 | Swisher | 70/34 |
| 4,564,167 | 1/1986 | Smith | 248/552 |
| 4,585,202 | 4/1986 | Parsekian | 248/553 |
| 4,634,009 | 1/1987 | Gassaway | 70/57 |
| 4,696,449 | 9/1987 | Woo et al. | 248/553 |
| 4,747,280 | 5/1988 | Shaw | 70/279 |
| 4,833,465 | 5/1989 | Abend et al. | 70/413 X |
| 4,881,386 | 11/1989 | Glines | 70/58 X |
| 4,966,020 | 10/1990 | Fotheringham et al. | 70/276 |
| 5,052,651 | 10/1991 | Guddee | 248/552 |
| 5,085,395 | 2/1992 | Frater et al. | 248/552 |
| 5,216,909 | 6/1993 | Armoogam | 70/278 |
| 5,257,581 | 11/1993 | Welling | 70/278 |
| 5,299,436 | 4/1994 | Spitzer | 70/58 |

*Primary Examiner*—Suzanne L. Dino
*Attorney, Agent, or Firm*—Bernard L. Kleinke; Peter P. Scott

[57] ABSTRACT

A security apparatus for attaching a portable unit to be protected to a supporting surface. The security apparatus includes a normally deactivated passive locking unit, which is activated by an electronic key unit, which is portable and moved adjacent to the passive locking unit to power it. The key unit includes a device for coupling electromagnetically the key and the locking units to transmit electrical power therebetween. A magnet is concealed within the security device to activate the electronic key, only when it is placed in the proper position relative thereto. Additionally, a mechanical arrangement for a locking pin is employed to further provide a level of sophistication before the actual unlocking of the device occurs.

13 Claims, 7 Drawing Sheets

FAST ACCESS ELECTRONIC LOCKING SYSTEM AND METHOD OF USING SAME

CROSS-REFERENCE TO RELATED APPLICATIONS

This is a continuation of application Ser. No. 08/206,974, filed Mar. 7, 1994 now abn. entitled, FAST ACCESS ELECTRONIC SYSTEM AND METHOD OF USING SAME which is a continuation of Ser. No. 07/781,011 filed Oct. 18, 1991 entitled FAST ACCESS ELECTRONIC SYSTEM AND METHOD 0F USING SAME which is now U.S. Pat. No. 5,299,436, which is a continuation-in-part application of U.S. patent application Ser. No. 07/492,737 filed Mar. 13, 1990, now U.S. Pat. No. 5,085,395, entitled "EQUIPMENT SECURITY APPARATUS AND KIT."

TECHNICAL FIELD

The present invention relates in general to a fast access electronic locking system and a method to enable a lockable member to be opened in a fast and efficient manner. The invention more particularly relates to such a fast access electronic locking system and a method of using it for enabling an authorized person to unlock a security device for access to a computer or other unit.

BACKGROUND ART

Electronic equipment, such as printers, computers, facsimile machines and the like, are used widely in offices and other organizations, such as schools and hospitals. Such valuable equipment, can be easily stolen from the premises, since they are portable and are very accessible. Thus, various security devices have been employed to fasten releasably a unit to be protected, to a supporting surface, such as a table top or desk.

Since it is desirable at times however, to remove such a unit from the supporting surface, the security device is openable and is locked in position during normal operation of the unit.

In the parent patent application, there is shown various techniques for locking the openable member of the security device. While such techniques have been satisfactorily employed for many applications, it would be highly desirable to have a fast access arrangement to facilitate the quick and easy removal of the unit from the security device. In this regard, in some organizations, there may be large numbers of computers or other such units being employed, and it may become desirable to service or replace all of them at the same time. Such an operation of removing the security equipment can be very time consuming and awkward for a person to remove the units from the security devices. Thus, a fast access locking arrangement would be highly desirable for such applications.

There have been different types and kinds of electronic fast access devices, such as key actuated input devices employing keypads, whereby security codes can be quickly input by an authorized person to unlock a protected unit. For example, electronic access for doors have been employed for many years. Such doors could be doors on safes or other security type areas, whereby a user can input the code to permit the door to be opened. In such an arrangement, however, the electronic circuits for the electronic access are usually powered by a battery which is mounted on the protected side of the door. Such an arrangement is not desirable for use with a table top security device since the battery can become drained to a point where it is unable to activate the circuits. In such a situation, there would be no possible way of obtaining ready access to replace the battery, unlike a safe where a mechanical lock can also be employed to gain access to the battery for replacement purposes.

Therefore, it would be highly desirable to have a new and improved fast access electronic lock, which is normally deactivated and does not include a source of power. At the same time, such a fast access electronic locking system should also be highly sophisticated to prevent, or at least discourage greatly a professional thief who may be very knowledgeable as to electronic access systems.

DISCLOSURE OF INVENTION

The principal object of the present invention is to provide a new and improved fast access electronic locking system and a method of using it, wherein the electronic locking system includes a locking portion which is totally passive and which does not include any source of electrical power.

Another object of the present invention is to provide such a new and improved fast access electronic locking system and method of using it, wherein the system is so sophisticated in nature to prevent, or at least greatly discourage, professional thieves or other unauthorized persons from defeating the locking arrangement.

Briefly, the above and further objects of the present invention are realized by providing a security apparatus for attaching a portable unit to be protected to a supporting surface. The security apparatus includes a normally deactivated passive locking unit, which is activated by a hand held electronic key unit, which is moved adjacent to the passive locking unit to power it. The key unit includes a device for coupling electromagnetically the key and the locking unit to transmit electrical power therebetween.

By employing an electronic key, an authorized user can input a combination code to quickly and easily unlock the security device. Such a System lends itself to a highly sophisticated security arrangement by various techniques according to the present invention. For example, each different code generated by a manually applied input, generates a different frequency signal. Also, a magnet is concealed within the security device to activate the electronic key, only when it is placed in the proper position relative thereto. Additionally, a mechanical arrangement for a locking pin is employed to further provide a level of sophistication before the actual unlocking of the device occurs.

BRIEF DESCRIPTION OF THE DRAWINGS

The above mentioned and other objects and features of this invention and the manner of attaining them will become apparent, and the invention itself will be best understood by reference to the following description of the embodiment of the invention in conjunction with the accompanying drawings, wherein.

BEST MODE FOR CARRYING OUT THE INVENTION

Figure 1:
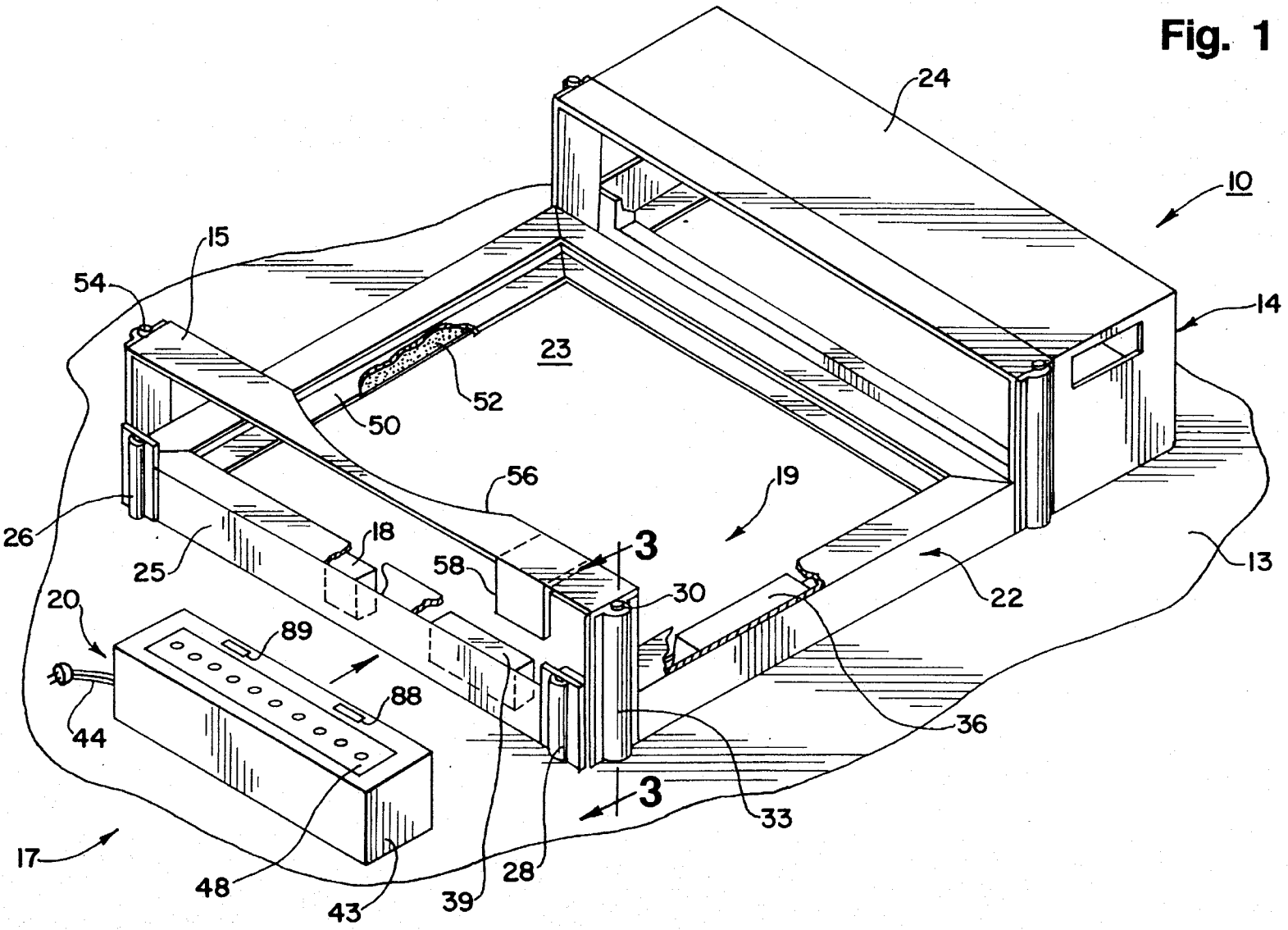
FIG. 1 is a pictorial view of a security apparatus including a fast access electronic locking system, which is constructed in accordance with the present invention.

Referring now to the drawings, and more particularly to FIG. 1 thereof, there is shown a security apparatus 10 which is constructed in accordance with the present invention and which is adapted to secure releasably a unit of portable equipment, such as a personal computer (not shown), to a supporting surface 13, such as a desk, table or other stationary surface.

Considering now the security apparatus 10 in greater detail with reference to FIG. 1, the security apparatus 10 generally comprises a security cradle or frame 14 adapted to be attached removably to the supporting surface 13 and having an access member 15 for securing the personal computer within the frame 14. The access member 15 is mounted pivotally to the security frame 14 and cooperates with a fast access electronic locking system shown generally at 17 for securing the access member 15 in a locked position thus, preventing the removal of the personal computer. In this regard, the access member 15 is openable under the control of the locking system 17 for permitting the personal computer to be received in or removed from the security frame 14.

The locking system 17 includes a passive lock shown generally at 19 for securing releasably the access member 15 in its locked position and a hand held active electronic key or energizing unit 20 for supplying electrical energy to the lock 19.

Figure 3:
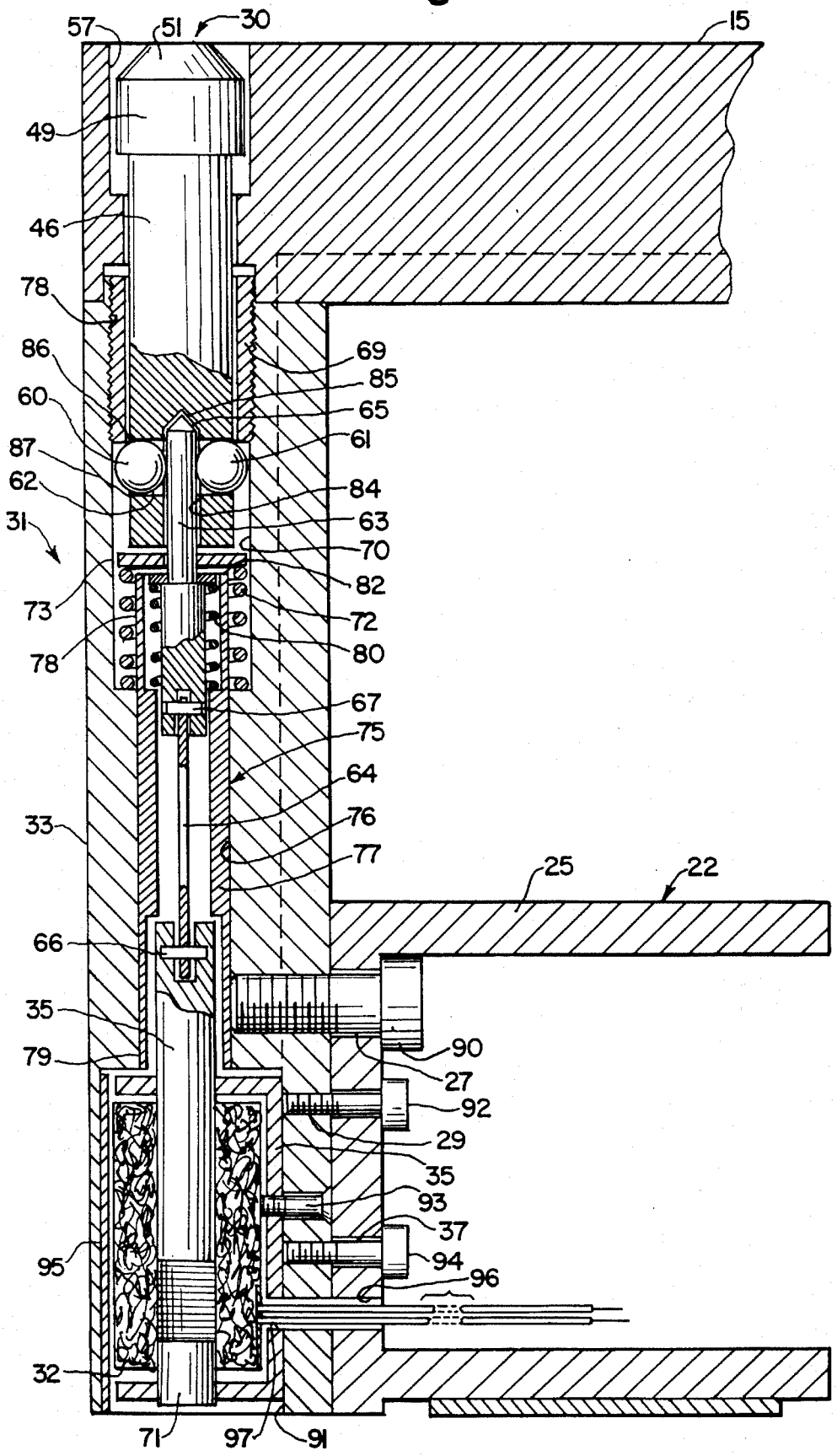
FIG. 3 is a sectional view of the electronic locking system of FIG. 1, taken substantially on line 3—3 of FIG. 1.

Considering now the security frame 14 in greater detail with reference to FIGS. 1 and 3, the security frame 14 generally includes a channel-shaped base member 22 which has an opening 23 complementarily shaped to the base portion of the personal computer. In this regard, when the access member 15 is opened pivotally, the personal computer may be placed by a user into the opening 23. After the computer is so positioned, the user moves the access member 15 to its closed position as shown in FIG. 1. When the access member 15 is moved to its closed position, it is locked in its closed position by the lock 19 as will be explained hereinafter in greater detail.

The security frame 14 also includes a cable shield or cover 24 to conceal the power and control cables of the personal computer. In this regard, the cables are protected and may not be removed from the personal computer by an unauthorized person. For the purpose of providing a level of sophisticated thief protection to the security apparatus 10, the electronic key or energizing unit 20 must be positioned at a precise designated location relative to the security frame 14 in order to open the lock 19. In order to assist an authorized user in properly positioning the energizing unit 20, the base member 22 includes a key locating front member 25 having a pair of spaced apart stops 26 and 28 respectively. In this regard, the user must position the energizing unit 20 adjacent to the key locating member 25 and abutted against the stop 28 to permit the lock 19 to be energized for actuating purposes.

Considering now the passive lock 19 in greater detail with reference to FIGS. 1 and 3, the lock 19 generally includes a locking pin 30 for securing the access member 15 in its closed or locked position and a pin actuating mechanism 31 (FIG. 3) having an electronically controlled solenoid 32 for enabling the locking pin 30 to be removed from the lock 19. The locking pin 30, actuating mechanism 31 and solenoid 32 are disposed in a housing 33 (FIG. 1) which is secured removably to the security frame 14 as will be explained hereinafter in greater detail.

The lock 19 also includes a capacitor 34 (FIG. 5A) for energizing the solenoid 32 and a decoding or actuating circuit shown generally at 36 (FIGS. 5A, 5B) for controlling the activation of the solenoid 32. As will be explained hereinafter, the activating circuit 36 is powered by the capacitor 34 and is responsive to a series of frequency coded signals generated by the energizing unit 20.

In order to enable the capacitor 34 to be charged, the lock 19 further includes part of a coupling transformer 40 having its secondary winding 39 (FIGS. 1 and 5A) disposed in the front member 25. In this regard, the front member 25 cooperates with the secondary winding 39 for enabling the capacitor 34 to be charged by electromagnetical conduction. As will be explained hereinafter, the coupling transformer 40 also enables the frequency coded pulses generated by the energizing unit 20 to be received by the actuating circuit 36.

Figure 4A:
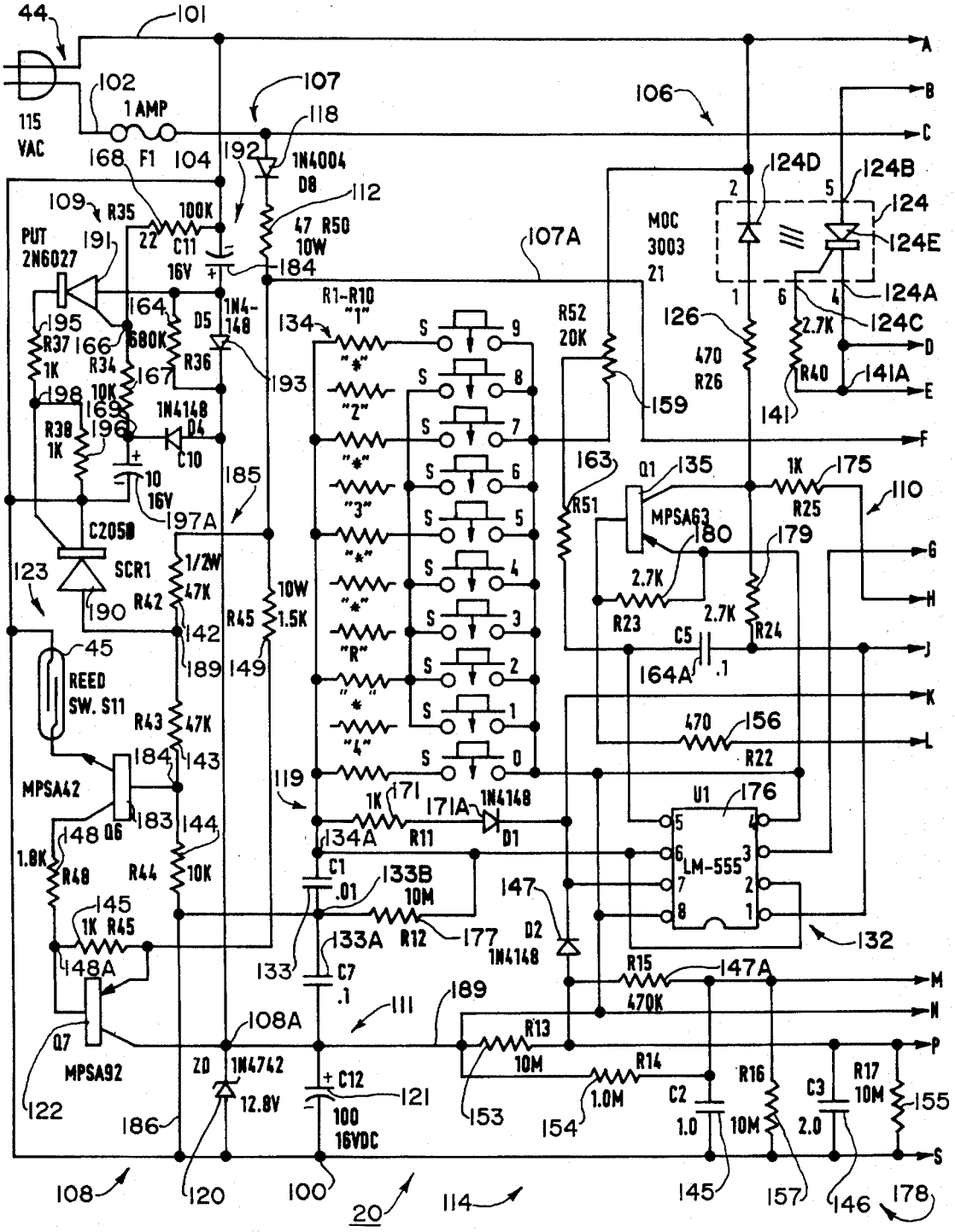
FIGS. 4A and 4B form a detailed schematic diagram of the electronic key unit of FIG. 1.
Figure 4B:
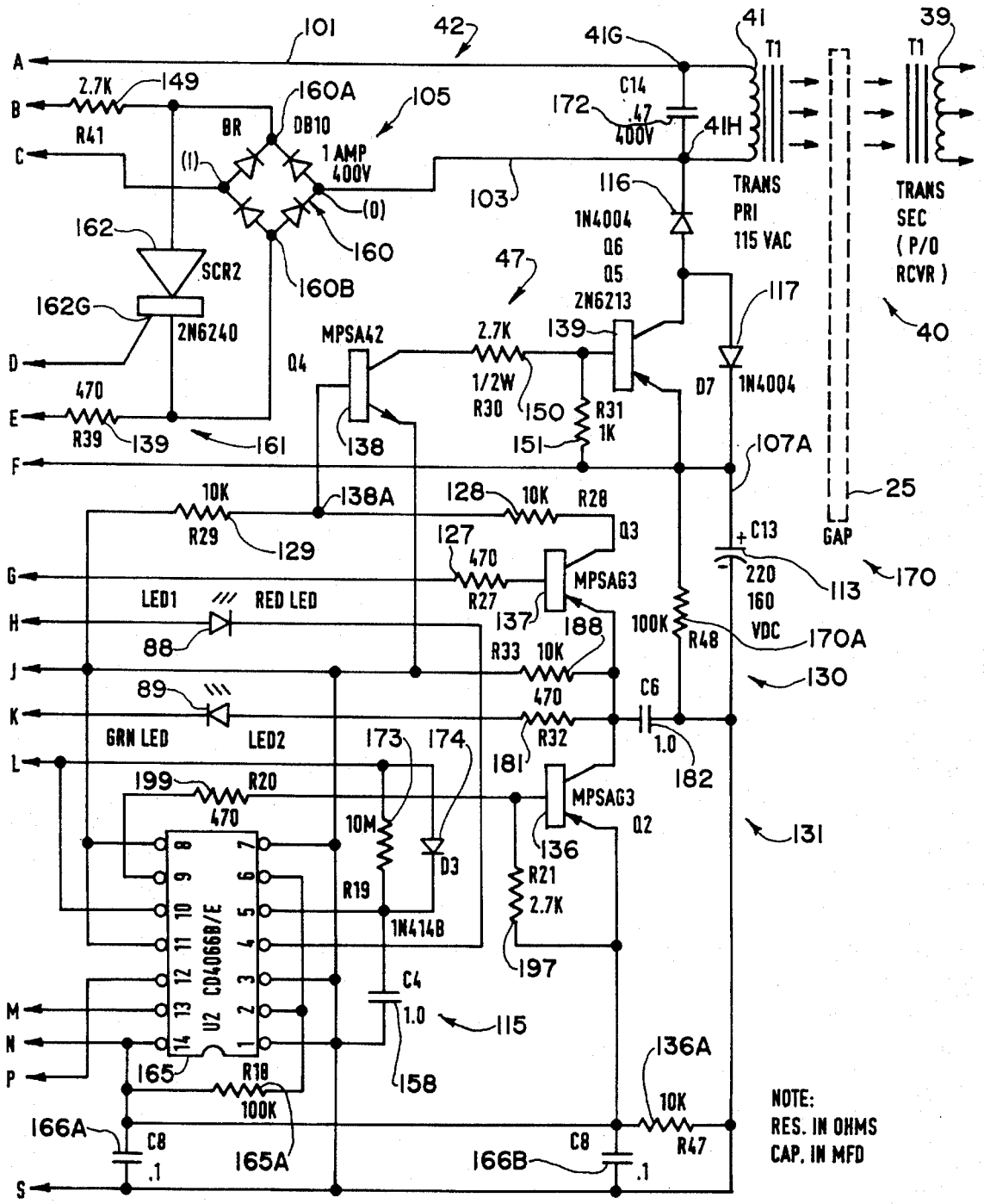

Considering now the electronic key or energizing unit 20 in greater detail with reference to FIGS. 1, 4A and 4B, the energizing unit 20 generally includes a housing 43 (FIG. 1) for enabling a concealed reed switch 45 to be moved manually by an authorized user to a position adjacent the front member 25 to facilitate its activation. In this regard, a magnet 18 (FIG. 1) disposed in the front member 25 actuates the reed switch 45 to an ON position when the energizing unit 20 is properly positioned against the stop 28. The energizing unit 20 further includes a power control circuit generally indicated at 42 for coupling 117 VAC 60 Hz power supplied via a power cord 44 to a primary winding 41 (FIG. 4B) forming another part of the coupling transformer 40.

Figure 2:
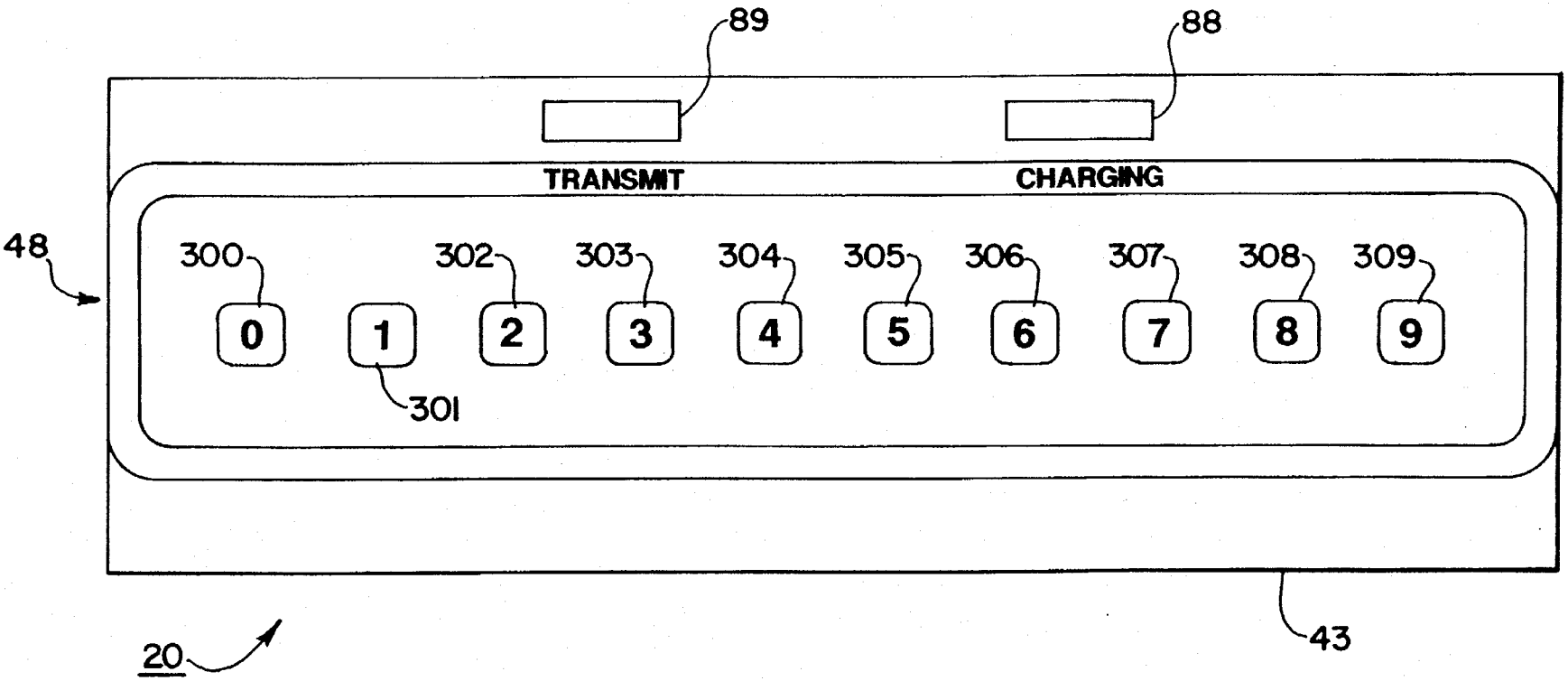
FIG. 2 is a face view of an electronic key unit of the locking system of FIG. 1.

The energizing unit 20 further includes an encoding circuit generally indicated at 47 (FIGS. 4A and 4B) which responds to a user activated keypad 48 to generate pulse coded frequency signals for causing the solenoid 32 to be activated. In this regard, the keypad 48 enables a user to enter a predetermined code to unlock the lock 19 as will be explained hereinafter. The keypad 48 generally includes a set of switch actuators 300–309 (FIG. 2) for enabling a user to actuate a corresponding set of switches S0–S9 (FIG. 4A).

Considering now the operation of the security apparatus 10 with reference to FIGS. 1–5B, when a user (not shown) positions the energizing unit 20 adjacent to the front locating member 25 with the right side of the unit 20 abutted against the stop 28, the magnet 18 causes the reed switch 45 to be closed to its ON position.

When the reed switch 45 is closed, power is applied to the power control circuit 42 which in turn enables 117 VAC power to be applied to the primary winding 41 of the coupling transformer 40. When power is applied to the primary winding 41, electromagnetic energy is coupled to the secondary winding 39 causing the capacitor 34 to be charged within a given period of time of about 10 seconds.

When a sufficient amount of time has elapsed for the capacitor 34 to be fully charged, the power control circuit 42 establishes an open circuit between the 117 VAC power and the primary winding 41 and enables the encoding circuit 47 to be coupled across the primary winding 41 so coded signal may be received by the actuating circuit 36. In this regard, a pair of light emitting diodes 88 and 89 disposed in the energizing unit 20 provide the user with a visual indication that he or she may now enter the predetermined code or combination for actuating the solenoid 32.

When the unit 20 is properly positioned adjacent the frame 14, the light emitting diode 88 is energized causing red light to be emitted therefrom. The red light is indicative that capacitor 34 is charging and that the user must wait before entering the combination code from keypad 48. After about 10 seconds, diode 88 is de-energized and diode 89 is energized causing green light to be emitted therefrom to provide a visual indication that the user may now enter the predetermined combination code.

As will be explained hereinafter in greater detail, when the 60 Hz 117 VAC power is initially applied to the secondary winding 39, the GREEN light emitting diode 89 switches ON for about one (1) second and then immediately OFF. The RED light emitting diode 88 is then activated as explained above. This sequence adds another level of sophisticated thief prevention as an unauthorized person seeing the alternating GREEN and RED visual indications may move the energizing unit 20 in an attempt to cause the GREEN diode 89 to be activated again. In this event, the capacitor 34 will not be charged sufficiently and thus, the solenoid 32 will be unable to be energized.

When diode 89 is reactivated, the user commences to enter the codes in proper sequence. In this regard, as another level of sophisticated theft prevention, the user has only about 10 seconds to enter the code sequence. Failure to enter the proper code sequence within this prescribed period of time will permanently disable the lock 19. Moreover, to initiate a new sequence to unlock lock 19, the energizer unit 20 must be disconnected from the primary power for about 15 seconds.

As the user enters the combination codes from the keypad 48, the encoding circuit 47 responds by generating a frequency coded signal for each code entered by the user. The coded signal is coupled to the primary winding 41, which in turn, couples the coded signal to the encoding or actuating circuit 36 via the secondary winding 39. When the user completes entering the proper coded sequence, the solenoid 32 will be actuated and the user will hear an audible sound of the actuation.

Although the solenoid 32 is actuated, the locking pin 30 will not pop up to a position to enable the user to remove it. In this regard, when the user hears the solenoid 32 being actuated, he or she must depress the locking pin 30 downwardly and then release the pin 30 immediately. In this regard, the mechanical force applied by the user assists the solenoid 32 and permits the locking pin 30 to pop up so that it may be removed from the lock 19. This feature adds still yet another level of sophisticated thief protection to the system.

After the locking pin 30 moves upwardly in the housing 33, its top portion may be grasped by the user and removed from the housing 33. Once the pin 30 has been removed from the housing 33, the access member 15 may be moved pivotally by the user from its closed or locked position (FIG. 1) to its opened position (not shown). When the access member 15 is moved to its open position, the user may remove the personal computer from the security frame 14.

Considering now the base member 22 in greater detail with reference to FIG. 1, the base member 22 is generally rectangular in shape and is constructed from a set of U-shaped channel members, such as the channel member 25. Each channel member includes a base portion, such as a base portion 50, having a double-sided tape 52 affixed to its undersurface. The tape 52 enables the frame 14 to be secured removably to any stationary surface, such as the surface 13. In this regard, the tape 52 includes an upper surface material which is heat sensitive and a lower surface material which is cold sensitive. Thus, by applying a gaseous coolant (not shown) to the base portion of each channel member, such as the base portion 50, the tape 52 will remain fixed to the frame 14 but will be released from the surface 13. Once the tape 52 loses its gripping force, the user may remove the frame 14 from the supporting surface 13.

The base member 22 also includes a set of openings 27, 29 and 37 (FIG. 3), for facilitating the mounting of the housing 33 to the base member 22. In order to permit the solenoid 32 to be coupled to the actuating circuit 36, the base member 22 also includes a coil access opening 96 (FIG. 3) that aligns with a corresponding opening in the housing 33 as will be described hereinafter in greater detail.

Considering now the access member 15 in greater detail with reference to FIG. 1: the access member 15 is adapted to be mounted pivotally to the frame 14 by a mounting pin 54. The top portion of the mounting pin 54 is complementarily shaped to the locking pin 30 and thus helps to facilitate the concealment of the real or actual locking pin 30 from a thief or unauthorized person. The access member 15 is generally flat elongated and rectangular in shape having a cut out portion, shown generally at 56 and a pin receiving opening 57 (FIG. 3) which is adapted to receive the lock pin 30. The cut out portion 56 is shaped complementarily to the face of a video monitor tube (not shown) so the tube may be disposed adjacent to the access member 15 in a secured position.

As best seen in FIG. 1, the access member 15 also includes an L-shaped disk protection plate 58 which depends downwardly a sufficient distance to block the access way to the disk drive unit (not shown) of the personal computer. In this regard, after the personal computer is positioned and locked in the frame 14, the plate 58 prevents a disk (not shown) in the disk drive unit from being removed from the apparatus 10.

Considering now the housing 33 in greater detail with reference to FIGS. 1 and 3, the housing 33 is mounted to the base 22 by a set of threaded mounting rods 90, 92 and 94 respectively. The housing 33 also includes a centrally disposed raised portion which is dimensioned for receiving therein the locking pin 30, the locking mechanism 31 and the solenoid 32 as will be explained hereinafter in greater detail.

As best seen in FIG. 3, the housing 33 is bored and includes a base cavity portion 91 dimensioned for receiving the solenoid 32 therein. The solenoid 32 is mounted in the cavity 91 by a threaded rod 93 and is surrounded on three sides by a steel hardened U-shaped shroud 95. The shroud 95 adds another level of sophisticated thief prevention as it prevents a thief from drilling through the solenoid 32 to permit the locking pin 30 to be released. The housing 33 also includes a transverse opening 97 in its base to permit the solenoid coil wires to be attached to a connector 208 (FIG. 5A) for coupling the solenoid 32 to the capacitor 34 and to the actuating circuit 36.

Considering now the locking pin 30 and the pin activating mechanism 31 in greater detail with reference to FIG. 3, the pin 30 includes an elongated rod-like shaft 46 having an enlarged head 49 which terminates in a conically shaped top portion 51. The lower portion of the shaft 46 includes a transverse bore 62 which is dimensioned for receiving therein a pair of locking balls 60 and 61. The balls 60 and 61 are retained within the bore 62 by a pair of circular pressure springs 86 and 87. The lower portion of the shaft 46 also includes a centrally disposed longitudinal bore 84 which is dimensioned for receiving therein a pin locking rod 63. The bore 84 extends through the transverse bore 62 and terminates in a conically shaped wall 85.

The pin locking rod 63 has a conically shaped tip portion 65 and has a sufficient diameter to cause the locking balls 60 and 61 to be camed radially outwardly a sufficient distance to prevent the pin 30 from being removed from the housing 33. In this regard, the pin locking rod 63 holds the balls 60 and 61 in a spaced apart manner as shown in FIG. 3 when rod 63 is extended upwardly through bore 62.

The pin locking rod 63 is connected to the solenoid 32 by a solenoid plunger 35 through a thin elongated link 64. A pair of dowel pins 66 and 67 connect opposite ends of the link 64 to the plunger 35 and the rod 63 respectively.

A lock pin sleeve 69 is received threadably within an opening or bore 70 having an upper threaded portion 78 disposed at a top portion of the housing 33. The sleeve 69 is dimensioned to receive a portion of the pin 30 and cooperates with the balls 60 and 61 respectively to prevent the locking pin 30 from being removed from the opening 57. In this regard, when the balls 60 and 61 are disposed in a spaced apart position as shown in FIG. 3, they engage the lower terminal end of the sleeve 69, thus preventing the pin 30 from being removed.

The locking mechanism 31 also includes a lock pin pop-up spring 72 which urges resiliently the lock pin 30 axially upwardly through the opening 57 a sufficient distance to permit the head 49 of the pin 30 to be grasped by a user. The spring 72 is disposed at the base of bore 78 and is retained within the bore 70 by a spring keeper 73 which is disposed adjacent to the base of the locking pin 30. In this regard, the spring keeper 73 has an outer diameter which is greater than the opening in the sleeve 69. Therefore, the sleeve 69 functions as a stop retaining the keeper 73 as well as the spring 72 within the bore 70.

In order to prevent the link 64 from being drilled apart by a thief attempting to gain access to the protected equipment, a steel hardened casing or sleeve 75 is received in a centrally disposed bore 76 at the base of bore 70. The sleeve 75 is mounted removably within the bore 76 by a threaded rod 90. The rod 90 is concealed within the base 22 and may not be accessed when equipment is secured within the frame 14. The rod 90 also secures the housing 33 to the base member 22.

As best seen in FIG. 3, the sleeve 75 includes a centrally disposed pin locking rod receiving portion 77 which is integrally connected to an upper spring receiving portion 78 and a lower mounting portion 79. The upper and lower portions 78 and 79 respectively, have larger internal diameters than the central portion.77. In this regard, the lower portion 79 has a sufficient internal diameter for receiving a portion of the plunger 35 therein. The lower portion 79 also forms a shoulder 88 with the central portion 77 which prevents the plunger 35 from traveling upwardly into the central portion 77.

The upper portion 78 is dimensioned for receiving therein a rod locking pressure spring 80. The rod locking pressure spring 80 is retained within the upper portion 78 by a retaining clip 82 which is dimensioned to be received within the upper portion 78 and mounted to the rod 63.

The spring 80 urges the locking pin rod 63 resiliently upwardly into the complementarily shaped centrally disposed bore 84 extending upwardly through the base of the locking pin 30. In this regard, the spring 80 exerts a sufficient amount of force against the locking pin rod 63 to resist the counter force of the solenoid 32 from retracting the rod 63 downwardly. This is a key feature of the present invention because even though the solenoid 32 is actuated it does not by itself exert a sufficient amount of force to retract the rod 63 from between balls 60 and 61.

In order to release the pin 30, the user must press downwardly on pin 30 causing the wall 85 to engage the tip portion 65 with a sufficient force to overcome the biasing force of the pressure spring 80. This added force exerted by the user permits the solenoid 32 to retract the rod 63 downwardly to engage or bottom out against a stop 71. In this regard, the rod 63 is removed from between the balls 60 and 61, which in turn are urged resiliently radially inwardly together by the springs 86 and 87.

When the balls 60 and 61 are urged together, they no longer engage the sleeve 69. Thus, when the user releases the downward pressure from the pin 30, the spring 72 urges the pin 30 resiliently upwardly through the opening 57. In this regard, the balls 60 and 61 now serve as bearings allowing the pin 30 to freely travel upwardly through the sleeve 69.

It should be understood that once the solenoid 32 is deactivated by the capacitor 34 being fully discharged, the plunger 35 is released allowing the rod 63 to be urged resiliently upwardly by the spring 80. In this regard, when the pin 30 is once again inserted a sufficient distance downwardly into the sleeve 69 the rod 63 will force the balls 60 and 61 to become spaced apart once again, locking the pin 30 within the access member 15.

Considering now the power control circuit 42 in greater detail with reference to FIGS. 4A and 4B, the power control circuit 42 generally includes an alternating current (AC) power control circuit generally indicated at 105 (FIG. 4B) for coupling primary power to the primary winding 41 of the coupling transformer 40 and a direct current (DC) power control circuit generally indicated at 107 (FIG. 4A) for providing direct current power for the energizer circuitry. In this regard, the direct current power control circuit 107 includes an electronic power ON-OFF switch shown generally at 123 (FIG. 4A) which is controlled by the activation of the reed switch 45 for activating the energizer unit 20 as will be explained hereinafter in greater detail.

In order to provide another level of sophistication to facilitate theft protection, the power control circuit 42 further includes a 40 second lock-out timer generally indicated at 109 (FIG. 4A) which prevents the energizer unit 20 from coupling ac power or encoded signals to the primary winding 41 for longer than 40 seconds.

Considering now the encoding circuit 47 in greater detail with reference to FIGS. 4A and 4B, the encoding circuit 47 generally includes a frequency pulse generator, generally indicated at 114 (FIG. 4A) for producing encoded frequency signals and a coupling control circuit generally indicated at 115 (FIG. 4B) for controlling a pair of electronic switches shown generally at 110 (FIG. 4A) and 131 (FIG. 4B) respectively. In this regard, when switch 110 is biased ON, it enables the AC power control circuit 105 to be activated, allowing 60 Hz 117 VAC power to be coupled to the primary winding 41 of the coupling transformer. Alternately, when switch 131 is biased ON, it disables the coupling of 60 Hz power to the primary winding 41 and enables the frequency pulse generator 114 to be coupled to the primary winding 41. In this regard, transformer 40 is pulsed with high frequency encoded signals when the user enters combination codes.

Considering now the AC power control circuit 105 in greater detail with reference to FIGS. 4A and 4B, the AC power control circuit 105 generally includes a full wave bridge rectifier 160 (FIG. 4B) for supplying 117 VAC 60 Hz power to the primary winding 41 of transformer 40 and opto-isolator circuit shown generally at 106 (FIG. 4A) which establishes a conduction path between an input node (I) and an output node (0) of the bridge rectifier 160. In this regard, when the isolator 106 is enabled by the low voltage electronic AC power control switch 110, as will be explained hereinafter in greater detail, an electrical conduction path is established from the power cord 44 to the primary winding 41 of the coupling transformer via a fuse 104 and the bridge rectifier 160.

Considering now the opto-isolation circuit 106 in greater detail with reference to FIG. 4A, the opto-isolation circuit 106 generally includes an opto-isolator 124 having a light emitting diode 124D and silicon controlled rectifier 124E for isolating the primary 117 VAC power from the low voltage electronic AC power control switch 110. In this regard, the diode 124D is connected between ground and the AC power control switch 110 via a pull-up resistor 126.

The opto-isolation circuit 106 further includes a silicon controlled rectifier (SCR) 162 for controlling the conduction of current through the bridge rectifier 160. SCR 162 is connected across a pair of bridge nodes 160A and 160B respectively of the diode bridge 160 and across a pair of isolated output nodes 124A (pin 4) and 124B (pin 5) of the opto-isolator 124 via a 470 ohm resistor 139 and a 2.7K ohm resistor 149 respectively.

For the purpose of controlling the biasing of SCR 162 ON or OFF, a gate input node 162G of SCR 162 is connected to a common node 141A between resistor 139 and the output node 124A (pin 5) and to another isolated output node 124C (pin 6) of the opto-isolator 124 via a 2.7K ohm resistor 141. In this regard, when the SCR 162 is biased ON, it establishes a conducting path for the primary input power via an input conductor 102 connected to cord 44, through fuse 104, thence to the input node (I) of the bridge rectifier 160, then to the primary winding 41 of the coupling transformer via a conductor 103 connected between an output node (0) of the rectifier 160 and a hot node 41H of the primary winding 41. A ground node 41G connected to the primary winding 41 provides a return path to ground via conductor 101.

Considering now the operation of the opto-isolation circuit 106, when the AC control switch 110 is biased ON, the opto-isolator 124 begins to conduct current through diode 124D. The current through diode 124D in turn, causes SCR 124E to be gated ON which biases SCR 162 ON. When SCR 162 is biased ON, a short circuit is established between nodes 160A and 160B of the bridge rectifier 160 thus, causing the conduction of primary power through the primary winding 41. Conversely, when the AC control switch 110 is biased OFF, the opto-isolator diode 124D does not conduct, which in turn causes SCR 162 to be biased OFF. When SCR 162 is biased OFF, the short circuit between nodes 160A and 160B is removed, thus preventing conduction of primary power through the primary winding 41 and the diode bridge 160.

Considering now the DC power control circuit 107 in greater detail with reference to FIGS. 4A and 4B, the DC power control-circuit 107 generally includes an AC to DC rectifier generally indicated at 170 (FIG. 4B) and a DC power supply 108 (FIG. 4A) having a zener regulator 111. The rectifier 170 provides a basic source of DC power for energizing the power supply 108 which in turn provides a source of low voltage DC power for the encoding circuit 47.

As best seen in FIGS. 4A and 4B, the AC to DC rectifier 170 generally includes a suitably poled diode 118 and current limiting resistor 112 for coupling power between the power cord 44 and the power supply 108. In this regard, during positive half cycles of the sinusoidal input power, energy is supplied to the power supply 108. The rectifier 170 further includes a filter arrangement in the form of a 220 μf 160 VDC capacitor 113 and a 100K ohm resistor 170A (FIG. 4B). Capacitor 113 and resistor 170A are connected between the resistor 112 and ground potential for the purpose of shaping the half wave pulses received from the primary power source through the diode 118 and resistor 112, whereby the capacitor 113 charges to about 150 VDC and causes a reduced average current demand by the rectifier 70.

The output power from the rectifier 170 is connected to the zener regulated low voltage power supply 108 via a power conductor 107A and the power ON/OFF switch 123. The power switch 123 generally includes a MPSA42 power transistor 183 having its emitter connected to a ground node 100 through the reed switch 45. In this regard, so long as the reed switch 45 is in an OPEN position as shown in FIG. 4A, transistor 183 is unable to conduct current thus, preventing the power supply 108 from being energized.

In order to bias transistor 183 to its initializing state, the base of transistor 183 is connected to the output of rectifier 170 through a voltage divider network 185 having a pair of voltage divider nodes 184 and 187 respectively. The node 184 is connected to the base of transistor 183 while node 187 is connected to the input of the lockout timer 109 as will be explained hereinafter in greater detail.

The voltage divider network 185 generally includes a set of three resistors 142, 143 and 144 connected in series between the output of the rectifier 170 via the conductor 107A and ground via a conductor 186. Resistor 142 is connected by node 187 to resistor 143 and resistor 143 in turn, is connected to resistor 144 through node 184. Resistor 144 is connected between node 184 and ground potential via the conductor 186.

Considering now the zener regulated supply 108 in greater detail with reference to FIG. 4A, the supply 108 generally includes a MPSA92 power transistor 122 having its emitter connected to the output of the regulator 170 via a current limiting resistor 149 for supplying 12 VDC power to the encoding circuit 47 and switches 110 and 131 respectively. The base bias voltage for transistor 122 is fixed by a voltage divider network consisting of a 1.8K ohm resistor 148 connected to the power switch 123 via the collector output of transistor 183, and a 1K ohm resistor 45 connected between a voltage divider node 148A and the output of the regulator 170 via resistor 149. As best seen in FIG. 4A, the base of transistor 122 is connected to the voltage divider node 148A between resistor 145 and resistor 148.

The power supply 108S further includes a zener regulator 111 having an output node 108A connected via a conductor 189 which serves as a power buss for distributing low voltage power to the energizing circuitry. The regulator 111 generally includes an 1N4742 zener diode 120 and a 100 μf 16 VDC capacitor 121 for regulating the low voltage direct current power relative to variations in the primary power. Diode 120 and capacitor 121 are connected in parallel between the output node 108A and ground node 100.

Considering now the operation of the low voltage supply 108 and its associated power ON/OFF switch 123 with reference to FIGS. 4A and 4B, when the power cord 44 is connected to a source of primary 117 VAC power, rectifier 170 causes bias voltages to be applied to the base of transistor 183 and the emitter of transistor 122. However, as the reed switch 45 is disposed normally in an OPEN condition, current is unable to flow through transistor 183 which in turn prevents transistor 122 from being biased ON. When the reed switch 45 is CLOSED, current flows through transistor 183 causing transistor 122 to be biased ON. When transistor 122 is biased ON its collector tends to rise towards 150 VDC but is immediately clamped to about 12 VDC by the zener diode 120 and capacitor 121.

Considering now the lockout timer 109 in greater detail with reference to FIG. 4A, the timer 109 generally includes a trigger in the form of a C205 D silicon controlled rectifier 190 for coupling the output of rectifier 170 to ground in order to cause transistor 183 to be biased OFF. In this regard, when transistor 183 is biased OFF, the power switch 123 is turned OFF causing the energizer unit 20 to be deactivated.

In order to provide a 40 second timing constant, the timer 109 further includes a timing network 192 for causing the gate of SCR 190 to be biased ON through a biasing circuit comprising a 2N6027 PUT 191 and voltage divider network consisting of a pair of 1K ohm resistors 195 and 196 connected by a divider node 198. The timing network 192 generally includes a 680K ohm resistor 164, and a 22 μf 16 VDC capacitor 194 connected between node 108A of the zener regulator 111 and ground potential. A 1N4148 diode 193 isolates the input of PUT 191 from the 12 VDC power supplied by the power supply 108.

In order to properly bias the PUT 191, the timer 109 also includes a voltage divider network consisting of a 680K ohm resistor 167 and a 100K ohm resistor 168 having a voltage divider node 166 connected to the gate of the PUT 191. The biasing voltage for the gate of PUT 191 is established via a 10 μf 16 VDC capacitor 197A which is charged to about 10 volts via a coupling diode 199A whenever the zener regulator 111 clamps the output of transistor 122 to about 12 VDC.

Considering now the operation of the lockout timer 109 with reference to FIG. 4A, when the reed switch 45 closes to an ON position the 12 VDC output of power supply 108 is applied to diode 199A allowing it to conduct to charge capacitor 197A to about 10 VDC. When capacitor 197A is fully charged, a bias voltage is applied to the gate of PUT 191 via the voltage divider node 166.

The 12 VDC output of power supply 108 is also applied to capacitor 194 through resistor 164 and diode 193. In this regard, an RC time constant is established taking about 40 seconds for capacitor 194 to be fully charged. When capacitor 194 is fully charged, the PUT 191 fires allowing its output to rise to a positive voltage level.

when the output voltage of the PUT 191 rises to a positive level, the gate to SCR 191 is biased ON via the voltage divider node 198. In this regard, current flows from the AC to DC rectifier 170 through SCR 190 to ground via the resistor 142 causing the bias voltage for transistor 183 to be turned OFF. When transistor 183.is turned OFF, its effect is the same as causing reed switch 45 to be opened; thus, causing the energizer unit 20 to be deactivated.

To restart the energizer unit 20, the power cord 44 must be disconnected from the 117 VAC primary power source to allow the capacitor 113 to discharge through resistor.142 and SCR 190 to reduce the current flowing through SCR 190 to a sufficient level to turn SCR 190 OFF. This is an important feature of the present invention, as it serves as an anti-theft feature and also prevents the unit from being subjected to excessive heat generated from its components.

Considering now the frequency pulse generator 114 in greater detail with reference to FIGS. 4A and 4B, the frequency pulse generator 114 generally includes a tunable oscillator shown generally at 132 whose oscillation frequency is controlled by a variable RC network consisting of a 0.01 μf capacitor 133 connected in series with a bank of selectable resistors, generally indicated at 134. In this regard, the operating or output frequency of the tunable oscillator 132 is controlled by the capacitor 133 and one of the user selected resistors when the user depresses one of the switches (S0–S9) on the keypad 48.

The frequency pulse generator 114 further includes a biasing circuit 119 connected between the power supply 108 via a 0.1 μf decoupling capacitor 133A and a voltage node (pin 7) of oscillator 132. The biasing circuit 119 includes a 1K ohm resistor 171 connected in series with an 1N4148 diode 171A which has its cathode connected to the voltage node pin 7. The cathode of diode 171A is also connected to the cathode of the GREEN light emitting diode 89.

The tunable oscillator 132 generally includes an LM-555 voltage-controlled oscillator 176 and a calibrating circuit consisting of a 20K ohm variable resistor 159, a 47K current limiting resistor 163 and a 0.1 μf capacitor 164A. In this regard, adjusting resistor 159 causes the operating voltage on an input node (pin 5) of the oscillator 176 to be changed which in turn, causes the output frequency of the oscillator 176 to be either raised or lowered. Calibrating the output of oscillator 176 for any one of the resistors in the resistor bank 134 centers the operating frequency for each of the resistors thus, greatly simplifying the calibration procedure.

The oscillator 176 includes an internal comparator (not shown) having an input node (pin 6) for enabling the comparator to compare the charge voltage on capacitor 133 with a reference voltage. In this regard, as will be explained hereinafter in greater detail, whenever the voltage across the capacitor 133 reaches certain predetermined levels, the oscillator 176 permits capacitor 133 to be charged and discharged at a given frequency.

As best seen in FIG. 4A, the resistor bank 134 has a common node 134A connected to an input node (pin 6) of the oscillator 176 and to the output of the low voltage supply 108 through a 0.9 μf coupling capacitor 133A. A common node 133B connects the capacitor 133 to the ground node 100. A 10M ohm bias resistor 177 is connected between node 133B and input node (pin 6) of the oscillator 176.

Considering now the operation of the tunable oscillator 132 with reference to FIG. 4A, the oscillator 132 is normally in a quiescent state until a user depresses one of the switches S0–S9 in the resistor bank 134. In this regard, when the user depresses one of the switches, for example switch S5, the resistor (R3) associated with switch S5 is placed in series with capacitor 133 allowing it to be charged via the output node (pin 4). When capacitor 133 is charged to about 8 VDC, output node (pin 4) is switched to ground allowing capacitor 133 to be discharged to about 4 VDC. When capacitor 133 is discharged to about 4 VDC, output node (pin 4) is again switched to about 12 VDC to initiating another charge and discharge cycle. Therefore, the oscillator oscillates at a given frequency, such as an $f_1$ frequency.

Considering now the ac control switch 110 in greater detail with reference to FIG. 4A, switch 110 generally includes a transistor 135 connected between the opto-isolator 106 and the coupling control circuit 115 to control applying primary 117 VAC power to the primary winding 41 of coupling transformer 40. In this regard, the collector output of transistor 135 is connected respectively to the anode of diode 124D via resistor 126, a 2.7K ohm bleeder resistor 179 to ground potential, and a 1K ohm current limiting resistor 175 to the anode of the RED light emitting diode 88. The base bias Voltage for transistor 135 is provided via a 2.7K ohm bias resistor 180 connected between the base and emitter of transistor 135 and a 470 ohm bias resistor 156 connected between the base of transistor 135 and an output node (pin 10) of the coupling control circuit 115.

Considering now the pulse control switch 131 in greater detail with reference to FIG. 4A and 4B, switch 131 generally includes a transistor 136 connected between the primary winding 41 of the coupling transformer 40 via a frequency pulse power control circuit 130 and the coupling control circuit 115 to control applying high voltage frequency coded pulses to the primary winding 41. In this regard, the collector output of transistor 136 is connected respectively to the anode of the GREEN light emitting diode 89 via a 470 ohm current limiting resistor 181, a 10K ohm bleeder resistor 188 to ground potential, a 1.0 μf bypass tone-frequency capacitor 182 to ground potential and the emitter of a MPSA63 transistor 137 defining an input to the control circuit 130. The base bias voltage for transistor 136 is provided via a 2.7K ohm bias resistor 197 connected between the base and emitter of transistor 136 and a 470 ohm bias resistor 199 connected between the base of transistor 135 and an output node (pin 9) of the coupling control circuit 115. The emitter of transistor 136 is connected to ground potential via an RC network comprised of a 0.1 μf capacitor 166B and a 10K ohm resistor 136A.

Considering now the frequency pulse power control circuit 130 in greater detail with reference to FIGS. 4A and 4B, the pulse control circuit 130 provides a train of frequency coded high voltage power pulses to the primary winding of transformer 40 in response to a user depressing one of the code switches. The pulse control circuit 130 comprises a pair of transistors 137 and 138 coupled between the output of oscillator 132 and a power transistor 139 for driving the primary winding 41 with high voltage pulses. In this regard, transistor 137 turns ON and OFF at the same frequency as oscillator 132 and is biased ON through a 470 ohm resistor 127 connected between the base of transistor 137 and an output node pin 3 of the frequency pulse generator 114.

In order to turn transistor 138 ON and OFF at the same frequency as oscillator 132, the collector of transistor 137 is connected to the base of transistor 138 via a node 138A of a voltage divider network comprising a pair of 10K ohm resistors 128 and 129. In this regard, resistor 128 is connected between the collector of transistor 137 and node 38A, while resistor 129 is connected between node 138A and ground potential. The collector of transistor 138 is connected to the base of power transistor 139 through a 2.7K Ohm ½ watt coupling resistor 150. The base bias OFF voltage for transistor 139 is provided via a 1K ohm resistor 151, while the emitter of transistor 139 is connected to the 150 VDC output of rectifier 170.

In order to drive the primary winding 41 with high voltage pulse and to provide reverse spike voltage protection for transistor 139, a 1N4004 diode 117 is connected between the collector of transistor 139 and the output of rectifier 170. A 1N4004 coupling diode 116 provides negative current flow from the primary winding 41 through transistor 139.

Considering now the primary winding 41 of the transformer 40 with reference to FIG. 4A & 4B, a 0.47 μf 400 VDC capacitor 172 is coupled across the primary winding between the transformer nodes 41G and 41H in order to eliminate the flywheel effect produced by the high frequency pulses supplied by transistor 139. Capacitor 172 also enables the silicon controlled rectifier 162 to turn OFF from back emf in the absence of the secondary winding.

Considering now the coupling control circuit 115 in greater detail with reference to FIGS. 4A and 4B, the control circuit 115 generally includes a CD4066B/E output matrix circuit 165 (FIG. 4B) for controlling the enabling and disabling of the control switches 110 and 131 respectively and a timing circuit 178 (FIG. 4A) for determining switching periods between switch 110 and 131 respectively. In this regard, the timing circuit 178 assures that switches 110 and 131 will never be turned 0N simultaneously. The output matrix circuit 165 includes a set of four internal electronic switches (not shown) which are actuated ON or OFF by control voltages supplied on a set of control input nodes, pins 5, 6, 12 and 13 respectively. In this regard, whenever the input voltage on a control input node, such as pin 5 is at ground potential its-associated switch is OPEN. Conversely when the voltage is at about 6 VDC its associated switch is CLOSED connecting its output pins 3 and together for current conduction therebetween. Table I provides a summary of the control nodes and their associated switch nodes.

TABLE I

| Control Node | Switch Number | Switch between Switch Nodes |
|---|---|---|
| pin 5 | 1 | pin 3 and pin 4 |
| pin 6 | 2 | pin 8 and pin 9 |
| pin 12 | 3 | pin 10 and pin 11 |
| pin 13 | 4 | pin 1 and pin 2 |

As best seen in FIG. 4B, the control node (pin 6) of the output matrix 165 is connected to ground potential via a RC network comprised of a series connected 100K ohm resistors 165A and a 0.1 μf capacitor 166A. Considering now the timing circuit 178 in greater detail with reference to FIGS. 4A and 4B, the timing circuit includes a pair of RC networks for controlling the time periods between actuating switches 3 and 4 respectively of the output matrix 165. One of the RC network is connected between control node pin 12 and ground potential and includes a 2.0 μf capacitor 146 connected in parallel with a 10M ohm resistor 155. The control node pin 12 is further connected to the output node 188 via a 10M ohm resistor 153.

The other RC network is connected between control node pin 13 and ground potential and includes a 1.0 μf capacitor 145 connected in parallel with a 10M resistor 157. The control node pin 13 is further connected to the collector of transistor 136 via a 470K ohm resistor 147A, a 1N4148 diode 147, the light emitting diode 89 and the bleeder resistor 181.

Considering now the operation of the control circuit 115 with reference to FIGS. 4A and 4B, when the 12 VDC power is activated it is applied through a pair of resistors 153 and 154 to capacitors 146 and 145 respectively. 12 VDC power is also applied to the anode of diode 147 and the current limiting resistor 147A. In this regard, capacitor 146 is charged through resistor 153 to about 6 VDC. When capacitor 146 is charged, a positive voltage is applied to pin 12 of the output matrix circuit 165 through the voltage divider consisting of the resistors 153 and 155. Responsive to this voltage, internal switch 3 in the matrix 165 is biased ON which in turn applies a base bias voltage to transistor 135 from output pin 10 through coupling resistor 156.

In a similar manner, when capacitor 145 is charged, a positive voltage is applied to pin 13 of the output matrix circuit 165 through the voltage divider consisting of the resistors 147A and 157. This causes internal switch 4 of the output matrix 165 to be actuated removing the base bias voltage from transistor 136 so it does not conduct. As the impedance values of capacitor 145 and resistor 154 are substantially smaller than impedance value of capacitor 1461 and resistor 153, transistor 136 will be biased OFF approximately two or three seconds before transistor 135 will be biased ON.

When transistor 135 is biased ON, current flow to the optical isolator 106 to enable SCR 162 in the ac power control unit 105 to permit conduction of current though the primary winding of transformer 40 to energize the lock 19 as will be explained hereinafter in greater detail. Contrawise, if transistor 135 is biased OFF, current does not flow to the optical isolator 106 to enable SCR 162 and thus, current does not flow through the primary winding of transformer 40. From the foregoing, it should be understood that transistor 135 functions as an on/off switch for the primary power to transformer 40.

As best seen in FIG. 4B, the positive voltage on pin 10 of the output matrix 165 is also applied to input pin 5 of the matrix 165 via a resistor 173 connected in parallel with a diode 174 to ground through a 1.0 μf capacitor 158. In this regard, capacitor 158 charges and holds pin 5 high for a period of about 10 seconds after the bias voltage for transistor 135 is removed.

The positive voltage from transistor 135 is also applied to diode 88 through resistor 175 to the matrix 165 on pin 4. When pin 4 of the matrix 165 goes to a positive voltage, the output voltage on pin 5 of the matrix 165 is removed and capacitor 158 begins to discharge through resistor 165A to ground. Capacitor 158 discharges in about 10 seconds. The energizer unit 20 is now in a entry state waiting for a user to enter a code via the keypad 48.

Considering now the operation of the control circuit 115 when a user depresses a switch in switch bank 134, the emitter of transistor 135 is back biased preventing current conduction. Pin 7 of the oscillator 132 rises to a positive voltage, allowing current to flow through the light emitting diode 89 (GRN LED) to ground via the RC network consisting of resistor 181 and capacitor 182. Approximately ½ second later as soon as capacitor 182 charges, the pulse on/off switch 131 is turned ON via transistor 136 which in turn enables the frequency power control circuit 130.

When pin 3 of oscillator 132 goes positive, a positive base-bias voltage is applied to the base of a power control transistor 137 through resistor 127 to enable transistor 137 to conduct current at the selected frequency rate. As the collector of transistor 137 is coupled to the base of transistor 138 through a coupling resistor 128, a base bias is established for transistor 138. In this regard, transistor 138 turns ON and OFF at the same rate as transistor 137 causing the output of transistor 139 to generates a series of 150 VDC pulses which are applied to the primary winding 41 through diode 116.

When transistor 136 is turned ON, current flows through the GRN LED 89 to give a visual indication that the frequency coded signal has been sent to the actuating circuit 36.

When the user releases the selected switch, the positive voltage applied to pins 4 and 8 of the oscillator 132 is removed thus, terminating oscillation. This in turn removes the voltage from pin 3 of oscillator 132 to stop the pulse train coupled to transformer 40 by disabling the base bias of transistor 137 via resistor 127, which in turn disables transistors 138 and 139. Diode 147 also stops conducting allowing capacitors 145 and 146 to charge once again. In this regard, transistor 136 is biased OFF and approximately 2 to 3 seconds later transistor 135 is biased ON.

As best seen in FIG. 4A, when a user depresses one of the switches on keypad 48, diode 147 begins to conduct and acts as an immediate ground on capacitor 146, and resistor 155 to the control node pin 12 of the output matrix 165 which turns off transistor 135 via output node 10 of matrix 165. This in turn allows capacitor 145 to discharge slowly through resistor 147A causing pin 12 of the output matrix 165 to go low thus to switch ON transistor 136.

Figure 5A:
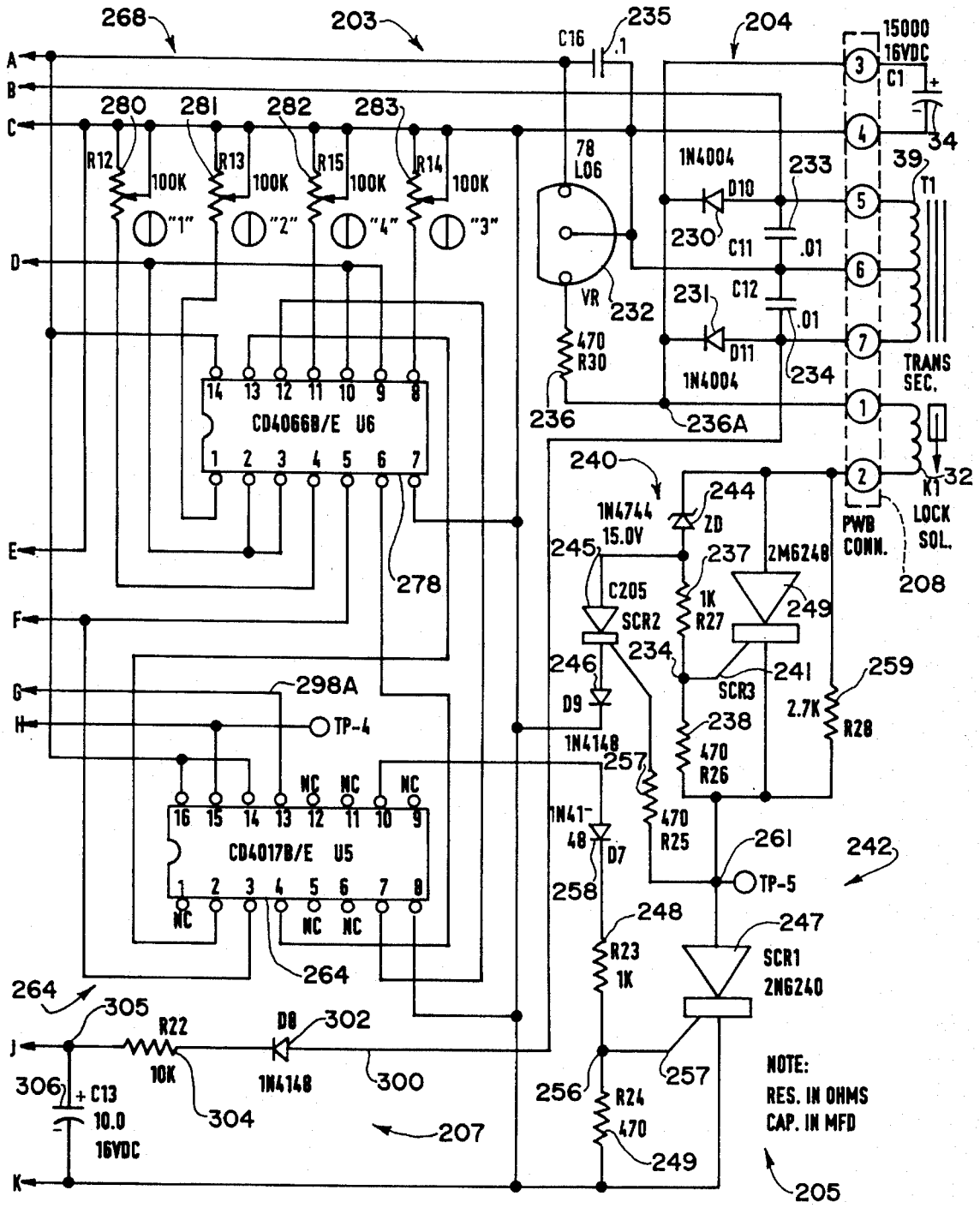
FIGS. 5A and 5B form a schematic diagram of a lock actuating unit forming part of the locking system of FIG. 1.
Figure 5B:
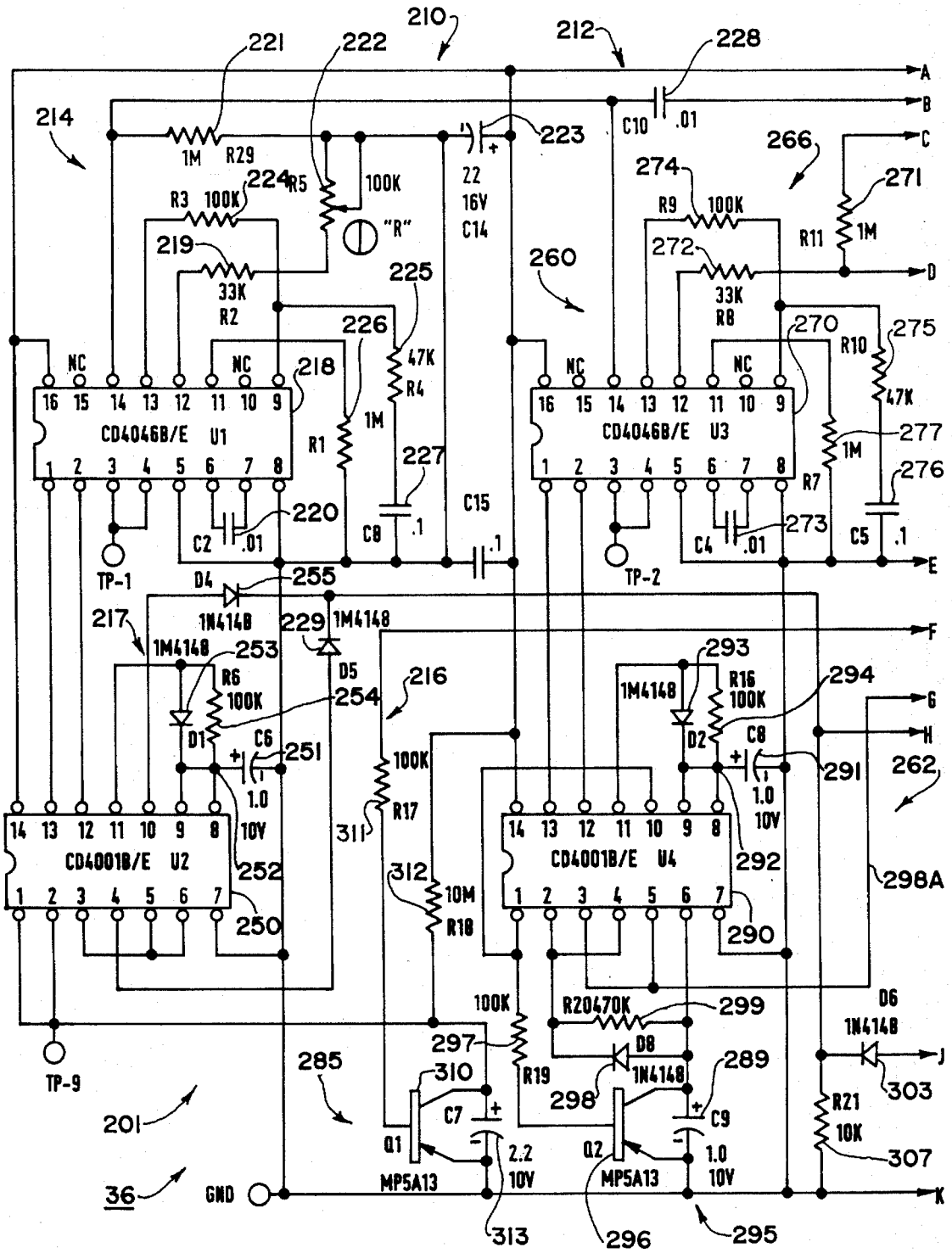

Considering now the actuating circuit 36 in greater detail with reference to FIGS. 5A and 5B, the actuating circuit 36 generally includes a decoder circuit generally indicated at 201 (FIG. 5B) for decoding the pulse coded signals generated by the energizer unit 20 and a power control circuit, generally indicated at 203 (FIG. 5A) for supplying a source of DC power to the decoder circuit 201. In this regard, the power control circuit 203 includes a voltage regulator 232 that regulates the power discharge from capacitor 34 for a sufficient period of time to enable the lock 19 to be opened.

The actuating circuit 36 also includes a solenoid control circuit, generally indicated at 205 (FIG. 5A) to enable the solenoid 32 to be activated when a proper activation code is decoded by the decoder circuit 201 and a timer circuit generally indicated at 285 for generating a master reset signal if the actuating circuit 36 fails to receive a correct frequency code signal from the energizer unit 20 within 10 seconds after DC power is applied to the actuating circuit 36.

Considering now the decoder circuit 201 in greater detail with reference to FIGS. 5A and 5B, the decoder circuit 201 generally includes a variable frequency decoder 210 (FIG. 5B) for determining whether the pulse coded frequency signals being received from the energizer unit 20 are within a given frequency range of acceptable signals and a calibrated frequency decoder 212 (FIG. 5B) for determining whether the pulse coded frequency signals being received from the energizer unit 20 are properly sequenced and at a given set of frequencies $f_1$, $f_2$, $f_3$ and $f_4$.

As will be explained hereinafter in greater detail, if the variable frequency decoder 210 is unable to lock onto an incoming frequency coded signal, the decoder 210 will cause a master reset signal to be generated, which in turn will disable the decoder unit 201 from decoding any further signals. In this regard, to enable the lock 19 to be opened, the user must unplug the energizer unit 20 and wait about 15 to 20 seconds to re-initiate a new sequence of coded signals.

In a similar manner, if a coded signal is received out of sequence but within an acceptable frequency range, the calibrated frequency decoder 212 will be disabled temporarily requiring the user to re-initiate a new sequence in proper order. If the new sequence is not initiated within about 3 seconds of the erroneous code, a master reset signal will be generated to disable the actuating circuit 36 completely as previously described.

Considering now the power control circuit 203 in greater detail with reference to FIG. 5B, the power control circuit 203 generally includes a diode bridge network 204 consisting of a pair of diode 230 and 231 for charging capacitor 34 with a DC voltage, and a set of decoupling capacitors 233–235 that cooperate with the voltage regulator 232 for regulating the DC power. In this regard, the voltage regulator 232 maintains a constant DC voltage for approximately 25 to 30 seconds as capacitor 34 discharges.

The printing wiring board connector 208 is utilized for interconnecting the solenoid 32, capacitor 34, diode bridge network 204 and secondary winding 39 of the coupling transformer 40. In this regard, in order to connect the solenoid 32 to the output of regulator 232, a node 236A is connected to the voltage regulator 232 via a coupling resistor 236 and to the solenoid 32 via pin 1 of the connector 208. Node 236A is also connected the cathodes of diodes 230 and 231 and to capacitor 34 via pin 3 of connector 208. The anodes of diodes 230 and 231 are connected in series with winding 239 via pins 5 and 7 of connector 208 respectively for the purpose of coupling the secondary winding 39 to capacitor 34.

In order to couplet he voltage regulator 232 to capacitor 34 and secondary winding 39, a center tap of the winding 39 is connected to the capacitor 34 via pins 4 and 6 respectively of the connector 208 and across the voltage regulator 232 through the filter capacitor 235.

The power control circuit 203 further includes a 60 Hz power detection circuit, generally indicated at 207 for generating a master reset signal to initialize the actuating circuit 36 when 60 Hz power is coupled from the energizer unit 20. As best seen in FIGS. 5A and 5B, the power detection circuit 207 is coupled to the secondary winding 39 via a conductor 300 and generally includes a pair of 1N4148 diodes 302 and 303 respectively. Diode 302 is connected in series with diode 303 through a 10K ohm resistor 304 which is also coupled to ground through a 10.0 μf 16 VDC capacitor 306. Diode 303 has its anode connected to a common node 305 between resistor 304 and capacitor 306. The cathode of diode 303 is also coupled to ground through a 10K ohm resistor 307.

In operation when power is applied to the anode of diode 302 it begins to conduct current allowing capacitor 306 to charge. As capacitor 306 charges a positive DC voltage is applied to the anode of diode 303 causing it to conduct so long as capacitor 306 is charging. When capacitor 306 is fully charged diode 302 is biased off which in turn causes the diode 303 to be biased off.

Considering now the solenoid control circuit 205 in greater detail with reference to FIG. 5A, the control circuit 205 is coupled between the output of the decoder circuit 201 and the voltage regulator 232, and generally includes a charge limiter 240 for limiting the charge on capacitor 34 and a trigger latch 242 for latching the solenoid 32 in a deactivated condition whenever the decoder circuit 201 generates a code detection signal. For the purpose of supplying power to the solenoid 32, the control circuit 205 further includes the coupling resistor 236 which is connected between the output of regulator 232 and the solenoid 32.

As best seem in FIG. 5A, the charge limiter 240 generally includes a 1N4744 15 VDC zener diode 244 connected in series with a C205 silicon controlled rectifier 245 and a 1N4148 diode 246 to ground. The cathode of the zener diode 244 is coupled to capacitor 34 through the solenoid 32. In this regard, when the 117 VAC power is applied to the lock 19 through the secondary winding 39 of transformer 40, capacitor 34 begins to charge toward 16 volts DC. Simultaneously with the application of power, current flows through the solenoid coil 32 to ground via the zener diode 244, SCR 245 and diode 246 until the voltage at pin 2 of the connector 208 reaches approximately 15.0 volts. When the voltage is at about 15.0 volts, the zener diode 244 clamps the voltage thus preventing the voltage across capacitor 34 from exceeding 16.5 volt because of the voltage drop across the combination of the zener diode 244 (15.0 volts), SCR 245 (0.7 volts) and diode 246 (0.7 volts) to ground is about 16.5 volts. SCR 245 has its gate coupled to a 2.7K ohm bias resistor 259 which is coupled to capacitor C34 through a 2.7K ohm resistor 259. In this regard, a common node 261 is normally held at a high voltage because the trigger circuit 2 is normally disabled.

Considering now the trigger latch circuit 242 in greater detail with reference to FIG. 5A, the trigger latch circuit 242 generally includes a 2N6240 silicon controlled rectifier 247 having a gate biased through a voltage decoder network consisting of a 1K ohm resistor 248 and a 470 ohm resistor 249. In this regard, a common node 256 between resistors 248 and 249 is connected to the gate input of SCR 247 by a conductor 257. The trigger latch circuit 242 also includes an 1N4148 diode 258 connected in series between an output pin 10 of the decoder circuit 201 and the resistor 248. In this regard, whenever the voltage on output pin 10 goes high, diode 258 begins to conduct enabling the gate to SCR 247. When the gate goes to SCR 247 goes high SCR 247 begins to conduct and a current path is established from the capacitor 34 to ground through solenoid 32, and SCR 247 via a 2.7K resistor 259 which is connected in parallel with a 2N6240 latching silicon controlled rectifier 249. In this regard, the latching SCR 249 has a gate biased through a voltage divider network consisting of a 1K ohm resistor 237 and a series connected 470K ohm resistor 238. More particularly, a common node 234 between resistors 237 and 238 is connected to the gate of SCR 249 by a conductor 241.

Considering now the variable frequency decoder 210 in greater detail with reference to FIG. 5B, the variable frequency decoder 210 generally includes a phase flock loop, generally indicated at 214 for generating a lock-on signal in response to an acceptable input signal from the energizing unit 20 and a detection control circuit, generally indicated at 216 for generating a lockout signal to disable the decoder circuit 201 whenever a given input signal has a frequency rate outside a given range. In this regard, once the decoder circuit 201 is disabled, the lock 19 is unable to be unlocked.

Considering now the phase lock loop 214 in greater detail with reference to FIG. 5B, the phase lock loop 214 generally includes a CD4046B/E edge-controlled digital memory network 218 having four flip-flop stages, control gating, a voltage controlled oscillator for generating a comparator input frequency, a comparator and a three-stage output circuit comprising p- and n- type drivers having a common output node. This type of phase comparator acts only on the positive edges of the signal and comparator inputs on pins 3 and 4 respectively. The duty cycles of the signal and comparator inputs are not important since positive transition controls the phase lock loop circuit.

If the signal-input frequency on pin 14 is higher than the comparator-input frequency on pins 3 and 4, the p-type output driver is maintained ON most of the time, and both the n- and p- drivers OFF (3 states) the remainder of the time. If the signal-input frequency is lower than the comparator-input frequency, the n-type output driver is maintained ON most of the time, and both the n- and p-drivers OFF (3 state) the remainder of the time.

If the input signal frequency and the comparator-input frequency are the same, but the signal input lags the comparator input in phase, the n-type output driver is maintained ON for a time corresponding to the phase difference. If the input signal and comparator-input frequencies are the same, but the comparator input loops the signal in phase, the p-type output driver is maintained ON for a time corresponding to the phase difference.

Subsequently, the capacitor voltage of a low pass filter consisting of a 47K ohm resistor 225 and a 0.1 μf capacitor 227 connected to an output pin 13 of the phase comparator via a 100K ohm resistor 224 is adjusted until the input signal and comparator signal are equal in both phase and frequency. At this stable point, both p- and n- type output drivers remain OFF and thus the phase comparator output on pin 13 becomes an open circuit and holds the voltage on capacitor 227. Moreover, an output or "phase pulse" signal on pin 1 rises to a positive or high level which is indicative of a locked signal condition. Thus, no phase difference exists between the input signal and the comparator input over a full frequency range of the internal voltage controlled oscillator (not shown) generating the comparator-input frequencies. When no signal is present on the input pin 14, the voltage controlled oscillator is adjusted to its lowest frequency for the phase comparator.

The voltage controlled oscillator frequency is established by a 0.01 μf capacitor 220 that cooperates with a pair of resistor networks such as a 1M ohm resistor 226 coupled to ground and a 33K ohm resistor 219 connected in series with an adjustable 100K ohm resistor 222 coupled to the output of the voltage regulator 232 via a 22 μf 16 VDC blocking capacitor 223. In this regard, the resistance value of resistor 222 may be adjusted to change the lowest operating frequency of the voltage controlled oscillator having its input on pin 9 and output on pin 4.

Considering now the detection circuit 216 in greater detail with reference to FIG. 5B, the detection circuit 216 generally includes a CD4001B/E gate module 250 having a set of internal NOR gates (not shown) used for controlling the operation of the variable frequency decoder 214. In this regard, an input gate pin 12 of module 250 is connected to an output pin 2 of the phase comparator and another input gate pin 13 is connected to the phase pulse output pin 1 of the comparator 218. Therefore, when pin 1 of the comparator 218 rises to a positive or high level, an output pin 11 of the pin 12 and pin 13 NOR gate goes to a negative or LOW level to prevent a reset pulse from being coupled to a 1N4148 diode 255 via a coupling network 217. In this regard, the coupling network generally consists of a 1.0 μf 10 VDC capacitor 251 connected between ground and a node 252 which is connected to input pins 8 and 9 and a parallel network of a 1N4148 diode 253 and a 100K ohm resistor 254, to output pin 11.

Table II shows the input and output pins for the gate module 250.

TABLE II

GATE MODULE 250

| INPUT PINS | | OUTPUT PIN |
|---|---|---|
| 12 | 13 | 11 |
| 8 | 9 | 10 |
| 1 | 2 | 3 |
| 5 | 6 | 4 |

Considering now the operation of the variable frequency decoder 210 with reference to FIGS. 5A and 5B, input signals from the energizer unit 20 are coupled to an input pin 14 of the phase lock loop 214 via the secondary winding 39 and a 0.01 μf coupling capacitor 228. The input signal is compared with the frequency of operation of the internal oscillator (not shown) causing a lock-on signal to be generated at output pins 1 and 2.

The output signal from the internal oscillator is received on input pins 12 and 13 of the detector circuit 216 which causes its output on pin 10 to remain low. If the internal oscillator is unable to lock-on to the input signal, its output on pin 1 does not generate a lock on signal which in turn causes the detection circuit 216 via the coupling network to generate a high output signal on pin 10 which resets the actuating circuit 36.

Considering now the calibrated frequency decoder 212 in greater detail with reference to FIGS. 5A and 5B, the calibrated frequency decoder 212 generally includes an adjustable frequency decoder, generally indicated at 260 for determining whether the pulse coded frequency signal from the energizer unit 20 is at a given frequency, a clock generator and transfer latch circuit 262 for generating a clock signal in response to the detection of an acceptable input signal from the energizer unit 20, and a counter 264 for generating a selection signal to change the operating frequency of the adjustable frequency decoder 260 as will be explained hereinafter in greater detail.

Considering now the adjustable frequency decoder 260 in greater detail with reference to FIGS. 5A and 5B, the adjustable frequency decoder 260 generally includes a tunable phase lock loop shown generally at 266 for generating a lock-on signal in response to an acceptable input signal from the energizing unit 20 and a frequency selection circuit, generally indicated at 268 for causing the phase lock loop 266 to be tuned to a predetermined frequency.

Considering now the phase lock loop 266 in greater detail with reference to FIG. 5B, the phase lock loop 266 includes a CD4046B/E digital memory network 270 that is substantially similar to memory network 218. In this regard, a low pass filter consisting of a 47K ohm resistor 275 and a 0.1 μf capacitor 276 is connected to an output pin 13 of the phase comparator via a 100K ohm resistor 274.

The phase lock loop 266 also includes a voltage controlled oscillator (not shown) whose frequency is established by a 0.01 μf capacitor 273 that cooperates with a pair of resistors, such as a 1M ohm resistor 277 coupled to ground and a 33K ohm resistor 272 connected in series with the output of a frequency selection circuit 268 via a 1M ohm resistor 271.

Considering now the clock generator and transfer latch 262 in greater detail with reference to FIG. 5B, the clock generator 262 generally includes a CD4001B/E integrated circuit chip 290 having a set of internal NOR gates (not shown). The chip 290 is substantially similar to the gate module 250. In this regard, whenever the output on pins 1 and 2 of phase lock loop 266 goes positive, the output of the voltage controlled oscillator in network 270 locks on to an input coded signal and a latching circuit generally indicated at 295 generates a clock pulse to advance the counter 264. A gating network consisting of a 1.0 μf coupling capacitor 291 to ground and a 1N4148 diode 293 connected in parallel with a 100K ohm resistor 294 is connected at a node 292 to gate input pins 8 and 9 of the chip 290. In this regard, when capacitor 291 is charged, the gate input at pins 8 and 9 rises to a positive level causing output pin 10 to rise to a positive level. When pin 10 is at a positive level a clock pulse is generated to advance counter 264 as will be explained in greater detail.

From the foregoing it should be understood that a short duration reset pulse from the cathode of diode 303 is applied to the counter 264 causing its output on pins 2, 4, 7 and 10 to go to a low voltage level and the output pin 3 to go to a high voltage level.

Considering now the timer circuit 285 in greater detail with reference to FIG. 5B, the timer 285 generally includes a switching transistor 310 having its base coupled to the output pin 3 of the counter 264 via a 1M ohm current limiting resistor 311. The collector of transistor 310 coupled to the output of the voltage regulator 232 through a 10M ohm pull up resistor 312. A 2.2 μf 10 VDC capacitor 313 is coupled between the emitter and collector of transistor 311.

In operation when the 60 Hz power detection circuit 207 generates its reset pulse, the counter 264 is initialized. In this regard, its output on pin 3 goes high which causes transistor 310 to be biased ON. When transistor 310 is biased ON, capacitor 313 begins to charge to about 10 VDC, which in turn causes transistor 310 to be back biased OFF in about 10 seconds. As best seen in FIG. 5B the pulse signal generated by transistor 310 is coupled to pins 1 and 2 of a pair of NOR gate inverter circuits (not shown) in detector circuit 250. In this regard, the inverter output on pin 10 is coupled to diode 255 for generating another reset signal. From the foregoing, it should be understood that the timer 285 will cause the counter 264 to be held in an initialize reset condition for about 10 seconds which is about the same period of time for capacitor 34 to become fully charged. Once the 10 second period of time has elapsed, transistor 310 is biased OFF causing the reset signal through diode 255 to go to a low voltage level.

Considering now the latching circuit 295 in greater detail with reference to FIG. 5B, the latching circuit 295 generally includes a switching transistor 296 having its base coupled to the set input (pin 1) of a NOR gate (not shown) through a 100K ohm current limiting resistor 297. The collector of transistor 296 is coupled to an output pin 6 of a NOR gate inverter (not shown) in circuit 290 and to a signal conditioning arrangement consisting of an 1N4148 diode 298 connected in parallel with a 470K ohm resistor 299. The inverter output on pins 3 and 5 of circuit 290 are connected to a clock input (pin 13) of the counter 264 via a conductor 298A. A 1.0 μf, 10 VDC capacitor 289 is connected between the emitter and collector of transistor 296.

In operation when the voltage controlled oscillator in the digital memory network 270 locks on to an input frequency coded signal its output locks on the input signal causing the signal on output pin 1 to rise to a positive level. When the output signal on pin 1 rises to a positive level output pin 11 goes negative, causing pin 10 to remain low. When the lock on pulse is removed from pin 1, the output on pin 10 goes positive. This positive signal on pin 10 is coupled to the latching circuit 295 through resistor 297 to cause transistor 296 to be biased ON. When transistor 296 is biased on, capacitor 289 begins to charge allowing diode 298 to conduct. When capacitor 289 is fully charged it back biases transistor 296 OFF which in turn, prevents diode 298 from conducting. When diode 298 conducts, the clock output pins 3 and 15 go HIGH allowing the counter 264 to be advanced to its next state. In this regard, the counter 264 has five outputs on pins 2, 3, 4, 7 and 10 only one which will be at a HIGH voltage at any given time. Thus, when pin 3 is HIGH, resistor 280 is selected, when pin 2 is HIGH, resistor 281 is selected, when pin 4 is HIGH, resistor 282 is selected, and when pin 7 is HIGH, resistor 283 is selected.

When the last coded frequency signal from energizer 20 is received in proper sequence, the output on pin 10 of the counter 26 rises to a HIGH signal level causing the trigger latch circuit 242 to be latched as will be explained hereinafter in greater detail.

Considering now the frequency selection circuit 268 in greater detail with reference to FIG. 5A, the frequency selection circuit 268 is coupled between counter 264 and the tunable phase lock loop 266 and generally included a four-position electronic selector switch 278 having a set of adjustable resistors 280, 281, 282 and 283. In this regard, depending upon the output states of the counter 264 an individual one of the resistors, such as resistor 280, is selected and placed in series with resistor 271 for biasing the voltage controlled oscillator in network 270 with a specific bias voltage to cause it to oscillate at various frequencies $f_1$, $f_2$, $f_3$ and $f_4$. The-exact frequencies at which the voltage controlled oscillator in network 270 oscillates is established by adjusting the resistors 280–283 to given frequencies that correspond to the predetermined frequency signals generated by the energizer unit 20.

Considering now the counter 264 in greater detail with reference to FIGS. 5A and 5B, the counter 264 is generally coupled between the clock generator 262 and the selector switch 278 and has one of its outputs (pin 10) connected to the trigger latch 205. The counter 264 is also connected to the timer circuit, generally indicated at 285 for generating a reset signal as will be explained hereinafter in greater detail.

Considering now the operation of the actuating circuit 36 in greater detail with reference to FIGS. 5A and 5B when the energizer unit 20 begins to transmit coded frequency signals, the 117 VAC primary power is removed from the primary winding 41 of the coupling transformer 40. In this regard, capacitor 34 is fully charged and functions as a battery source for the voltage regulator 232 which in turn provides-primary DC power for the actuating mechanism 31. More particularly, the voltage regulator 232 provides 6 VDC power which is sustained for about 25 seconds after the 117 VAC power is removed from primary windings of transformer 40. From the foregoing, it should be understood that capacitor 34 cooperates indirectly with the 40 second timer 109 disposed in the energizer unit 20 to function as a secondary anti-theft feature.

When power is applied to the secondary winding 39 via the energizer unit 20, the 60 Hz power detector 207 generates a reset pulse to initialize the actuating circuitry to receive coded frequency signals from the energizer unit 20. In this regard the 60 Hz power is applied from the secondary winding 39 to the anode of diode 302 cause it to conduct current. When diode 302 begun to conduct current, capacitor 306 begins to charge via resistor 304 causing a positive voltage to be applied to anode of diode 303. Diode 303 conducts so long as capacitor 306 is charging. When capacitor 306 is fully charged, diode 303 is biased off. From the foregoing it should be understood that a short duration reset pulse from the cathode of diode 303 is applied to pin 15 of counter 264 causing its outputs at 2, 4, 7, and 10 to be at a negative or LOW level and the output 3 to be at a positive or HIGH level.

When the output at pin 3 of counter 264 goes to a positive level, it provides a base bias voltage for the transistor 310 via resistor 311 allowing transistor 310 to conduct current. When transistor 310 conducts, a short circuit is established across capacitor 313. In this regard, when the output at pin 3 of counter 264 goes to a negative or low level the base bias for transistor 310 is removed to stop its conduction. Capacitor 313 then begins to charge for approximately 10 seconds through resistor 312. When capacitor 313 is fully charged, its positive voltage level is coupled to pins i and 2 of circuit 250 which in turn generates a reset pulse on its output pin 4. The reset pulse is coupled to counter 264 via a diode 229. From the foregoing, it should be understood that if the counter 264 is not advanced from its initial code receiving stage within 10 seconds of power being applied to the actuating circuit 36, the counter 264 will be reset.

After the actuating circuit 36 has been initialized, a series of individual frequency signals are received for each keypad entry made by the user. When the first coded frequency signal is received, it is coupled to the phase lock loop 214 and to the adjustable frequency decoder 260. The phase lock loop 214 determines whether the frequency of the signal is within the pre-established range of combination frequencies. In a similar manner, the adjustable frequency decoder 260 determines whether the frequency of the initial signal corresponds to the first pre-established frequency of frequency signals required to deactivate the actuating mechanism 31.

If the received signal is outside the allowable range of frequencies the phase lock loop 214 generates a lockout signal that resets the counter 264, thus preventing the actuating mechanism 31 from being unlocked. If the received signal is within the allowable range of frequencies, the phase lock loop 214 locks onto the frequency and thus, does not generate the lockout signal.

Considering now the operation of the adjustable frequency decoder 260 in greater detail with reference to FIGS. 5A and 5B, as noted earlier when the actuating circuit 36 was initialized, the counter 264 was reset to its initialized state causing the signal on its output pin 3 to be at a positive voltage level. This output signal from the counter 264 is coupled to the frequency selector circuit 268 which causes the resistor value of pot 280 to be coupled in series with resistor 272 of the combination frequency decoder. The impedance value of pot 280, resistor 272 and capacitor 273 establishes an operating voltage to control the voltage controlled oscillator 270 in the adjustable frequency decoder 260.

The resistors 274 and 275 cooperate with the capacitor 276 to couple the signal produced by the voltage controlled oscillator 270 to the comparator portion of the detector circuit 290. The input frequency received from the energizer on pin 14 is then compared with the frequency of the voltage controlled oscillator. If the detector 290 locates the frequency it will lock and produce a clock signal to advance the counter 264. In this regard, the signal on pin 3 of the counter 264 goes low and the output signal on pin 4 of the counter 264 goes to a positive value. When the signal on pin 4 goes high, the selector switch 278 decouples resistor 280 from the adjustable frequency decoder 260 and couples in the place of resistor 280, resistor 281. By substituting a new resistor value, the voltage control oscillator changes its output frequency to the next predetermined frequency for deactivating the actuating mechanism.

The above described interaction between the adjustable frequency decoder 260, clock generator 290, counter 264 and selector 278 is repeated for each of the subsequent frequency signals received from the energizer unit 20 with the exception of the output signals from counter 264 being changed to select different resistor value. If the sequence of frequency signals corresponds to the pre-established sequence, the detection of the last frequency signal in the sequence causes via the counter 264 the selector 278 to couple resistor 280 to the decoder and the output signal on pin 10 of the counter 264 to go to a positive or HIGH level. When the signal on pin 10 goes HIGH the diode 258 begins to conduct causing the solenoid 208 controlling the actuating mechanism 31 to be activated. More particularly, the gate for SCR 247 is enabled through resistors 248 and 249 to establish a current path from capacitor 34 to ground via the solenoid coil 32, resistor 259 and SCR 247. In this regard, when SCR 247 is triggered, the-resistor 259 holds. SCR 247 on or latched as capacitor 34 discharges. When node 261 goes low, SCR 245 is disabled through 257 and SCR 259 to be gated on if the voltage at pin 2 of the PWB 208 is above 15 volts to cause the zener diode 244 to conduct through the voltage divider resistors 237 and 238. After pin 2 of PWB 208 reaches 16.5 VDC, SCR 249 is triggered through SCR 247.

While particular embodiments of the present invention have been disclosed, it is to be understood that various different modifications are possible and are contemplated within the true spirit and scope of the appended claims. There is no intention, therefore, of limitations to the exact abstract or disclosure herein presented.

What is claimed is:

1. A security apparatus for attaching a unit to be protected to a supporting surface, comprising:

frame means including an upstanding pivot leg and an upstanding housing leg for securing the unit to the supporting surface, said frame means having elongated openable means for permitting the unit to be received therein or removed therefrom by an authorized user;

said openable means including a bar having a locking end securable to said housing leg and a pivoting end pivotally mounted to said pivot leg of said frame means for surrounding a portion of the unit, wherein said bar is pivoted to an opened position for receiving or removing the unit into or out of said frame means and to a closed position for securing the unit within said frame means;

said openable means further including a mounting pin, having a top portion, said pin being disposed near said bar pivoting end to facilitate pivotal movement of said bar about said pivot leg;

locking means for securing said bar in said closed position to help prevent the unit from being removed from said frame means by an unauthorized user;

said locking means including a removable locking pin, having a locking pin imperforate top portion and a lower shaft portion, said shaft portion being held releasably to prevent pivotal motion of said bar;

said locking pin imperforate top portion being complementary shaped and substantially similar in appearance to said mounting pin top portion to conceal the true function of said locking pin for security purposes;

said imperforate top portion further helping to prevent a tool from withdrawing said locking pin from said recess opening in said locking end of said locking bar when said locking pin is held releasably within said recess opening;

said locking means further including pin retaining means for securing releasably said shaft within said locking means to hold said bar in said closed position;

said upstanding housing leg having a cavity therein for confining and concealing substantially said locking means from view and for receiving said shaft portion of said locking pin to permit only the top portion thereof to be exposed to view so that an unauthorized person would not be aware that the locking pin can be removed to unlock said openable means;

means for controlling said retaining means to free said shaft therefrom for permitting the removal of said shaft from said cavity and the pivoting of said bar to said opened position;

said locking bar having means defining an opening for receiving completely said top portion of said locking pin to prevent said locking pin from being removed from the opening when the locking pin is retained in a locked position by said pin retaining means;

said locking bar further having means defining a small smooth shaft receiving opening in communication with said top receiving recess opening to receive said lower shaft portion of said locking pin to enable said shaft portion to extend into said cavity; and means for urging said locking pin axially outwardly out of said cavity to back said locking pin at least partially out of said upper recess opening in said bar to permit said locking pin to be completely withdrawn from said cavity manually by an authorized user without the aid of a tool, to free said locking bar to permit said locking pin to be moved pivotally about said pivoting end.

2. A security apparatus for attaching a unit according to claim 1, said means for controlling including:

passive receiving means responsive to a magnetic signal for activating electrically said retaining means under the control of the authorized user to facilitate the releasing of said locking pin from said locking means; and active energizing key means for supplying said magnetic signal to said passive receiving means to cause said passive receiving means to activate electrically said retaining means for releasing said locking pin to permit the authorized user to remove said locking pin.

3. A security apparatus for attaching a unit according to claim 2, wherein said locking pin lower shaft portion, having a transverse bore therethrough and a centrally disposed axially aligned bore extending through the bottom of said shaft and intersecting said transverse bore, includes a pair of locking balls within said transverse bore for engaging cammingly said retaining means to facilitate the releasing and securing of said locking pin, wherein said locking balls travel radially inwardly toward one another to permit said locking pin to be released from said locking means and said locking balls travel radially outwardly away from one another to secure said locking pin within said locking means.

4. A security apparatus for attaching a unit according to claim 3, said retaining means further including a pin activating mechanism having a pin locking rod that is sized and dimensioned to pass through the bottom of said shaft and into said centrally disposed axially aligned bore to engage said locking balls for camming them radially outwardly or to disengage from said locking balls to permit them to move radially inwardly, wherein said pin locking rod is retracted outwardly from said centrally disposed axially aligned bore through the bottom of said shaft to disengage the pin locking rod from said locking balls.

5. A security apparatus for attaching a unit according to claim 4, said pin activating mechanism further having a solenoid plunger coupled to said pin locking rod at a lower end thereof, and said retaining means further including a solenoid means for exerting a downwardly directed force on said solenoid plunger to facilitate the removal of said pin locking rod from said centrally disposed axially aligned bore when said retaining means is activated by said passive receiving means.

6. A security apparatus for attaching a unit according to claim 5, said pin activating mechanism further includes a rod locking pressure spring disposed between said pin locking rod and said frame means for biasing said solenoid plunger axially upwardly to partially counteract said downwardly directed force exerted by said solenoid means when said retaining means is activated electrically and for biasing said pin locking rod axially upwardly to engage said locking balls through said centrally disposed axially aligned bore when said retaining means is not activated.

7. A security apparatus for attaching a unit according to claim 6, said locking means further including a pop up spring for biasing said locking pin to permit said imperforate top portion to be temporarily extended substantially above said bar for facilitating the removal of said locking pin from said locking means.

8. A method for securing releasably a portable unit to be protected to a supporting surface by means of the apparatus according to claim 1, comprising:

using said frame means for securing the unit to the supporting surface;

pivoting said bar to a closed position to help prevent the unit from being removed from said frame means by an unauthorized user;

securing releasably said locking pin within said housing leg cavity with said retaining means to hold said bar in said closed position with the top portion of said locking pin within the locking bar opening;

freeing said locking pin from said retaining means for permitting the removal of said locking pin from said cavity manually without the aid of a tool and the pivoting of said bar to an opened position;

urging said locking pin axially inwardly into said cavity by applying an inwardly directed manual force to said imperforate top portion;

removing the application of said inward force, wherein said top portion is subsequently urged outwardly away from said cavity to back said top portion at least partially out of said opening in said bar;

withdrawing manually without the aid of a tool said freed locking pin to an unlocked position to release said bar; and pivoting said bar to said opened position to permit an authorized user to remove the unit from said frame means.

9. A method for securing releasably a portable unit according to claim 8, further comprising:

activating electrically a retaining means under the control of the authorized user to facilitate the releasing of said locking pin from said locking means; and supplying a magnetic signal to a passive receiving means to cause said passive receiving means to activate electrically said retaining means for releasing said locking pin to permit the authorized user to remove said locking pin.

10. A method for securing releasably a portable unit according to claim 9, further comprising:

extending a pin locking rod into an axially aligned bore passing through the bottom of said shaft;

engaging cammingly a pair of locking balls with said pin locking rod to facilitate the releasing and securing of said locking pin, wherein said locking balls travel radially inwardly toward one another to permit said locking pin to be released from said locking means when said pin locking rod is withdrawn from said bore, and said locking balls travel radially outwardly away from one another to secure said locking pin within said locking means when said pin locking rod is received within said bore.

11. A method for securing releasably a portable unit according to claim 10, further comprising:

exerting a downwardly directed force on a solenoid plunger mechanism to facilitate the removal of a pin activating mechanism from said locking pin.

12. A method for securing releasably a portable unit according to claim 11, further comprising:

biasing said solenoid plunger axially upwardly to partially counteract said downwardly directed force exerted by said solenoid means when said retaining means is activated electrically.

13. A method for securing releasably a portable unit according to claim 12, further comprising:

biasing said locking pin to permit said locking pin to be temporarily extended substantially above said bar for facilitating the removal of said locking pin from said locking means.

* * * * *